US010808466B2

(12) United States Patent
Porter et al.

(10) Patent No.: US 10,808,466 B2
(45) Date of Patent: Oct. 20, 2020

(54) PIPE HANDLING ASSEMBLY

(71) Applicant: The Charles Machine Works, Inc., Perry, OK (US)

(72) Inventors: Rick G. Porter, Perry, OK (US); Max A. Metcalf, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 16/256,620

(22) Filed: Jan. 24, 2019

(65) Prior Publication Data

US 2019/0234158 A1 Aug. 1, 2019

Related U.S. Application Data

(60) Provisional application No. 62/622,402, filed on Jan. 26, 2018.

(51) Int. Cl.

| | |
|---|---|
| ***E21B 19/15*** | (2006.01) |
| ***E21B 19/20*** | (2006.01) |
| *E21B 7/04* | (2006.01) |
| *E21B 7/02* | (2006.01) |
| *E21B 19/083* | (2006.01) |

(52) U.S. Cl.

CPC ..... *E21B 19/15* (2013.01); *E21B 19/20* (2013.01); *E21B 7/02* (2013.01); *E21B 7/046* (2013.01); *E21B 19/083* (2013.01)

(58) Field of Classification Search

CPC ..... E21B 19/15; E21B 19/20; E21B 19/083; E21B 7/02; E21B 7/046

USPC ..... 414/22.51–22.71

See application file for complete search history.

(56) References Cited

U.S. PATENT DOCUMENTS 4,018,092 A * 4/1977 Fletcher ..... F16H 27/04 74/96

5,556,253 A * 9/1996 Rozendaal ..... B65G 59/062 198/370.01

6,135,075 A * 10/2000 Boertje ..... F01L 1/08 123/90.16

(Continued)

FOREIGN PATENT DOCUMENTS

WO 2007041822 A1 4/2007

OTHER PUBLICATIONS

Korean Intellectual Property Office "PCT International Search Report" dated Nov. 17, 2015, 3 pages, Republic of Korea.

*Primary Examiner* — Lynn E Schwenning

(74) *Attorney, Agent, or Firm* — Tomlinson McKinstry, P.C.

(57) ABSTRACT

A pipe handling assembly carried by a horizontal boring machine includes a pipe box having a plurality of columns. One or more pipe sections may be received and stored in any of the columns. A pair of shuttle arms are used to move the pipe sections from the pipe box to a carriage included in the machine. The pipe column selection assembly includes an elongate rotatable shaft that carries a series of stop elements. A shaft-mounted pinion gear drives movement of the shuttle arms. A longitudinally positionable bolt element can block the rotational path of any selected one of the stop elements. Such blockage stops movement of the shuttle arms beneath a corresponding one of the columns. The pipe column selection assembly allows an operator to select which column to load or unload a pipe section into and from within a pipe box.

20 Claims, 21 Drawing Sheets

(56) References Cited

U.S. PATENT DOCUMENTS

| | | | | |
|---|---|---|---|---|
| 6,179,065 | B1 | 1/2001 | Payne et al. | |
| 6,332,502 | B1 | 12/2001 | Mills et al. | |
| 6,360,830 | B1 | 3/2002 | Price | |
| 6,474,931 | B1 * | 11/2002 | Austin | B65G 1/0442 414/745.7 |
| 7,011,166 | B2 * | 3/2006 | Koch | H02K 37/125 175/24 |
| 7,018,164 | B2 * | 3/2006 | Anthis | E21B 19/15 221/95 |
| 7,240,742 | B2 | 7/2007 | Sewell et al. | |
| 7,467,670 | B2 * | 12/2008 | Hartke | E21B 19/14 175/52 |
| 7,544,036 | B1 | 6/2009 | Randall et al. | |
| 7,600,584 | B2 | 10/2009 | Sewell et al. | |
| 7,694,751 | B2 * | 4/2010 | Hartke | E21B 19/15 175/52 |
| 9,127,518 | B1 | 9/2015 | Sewell | |
| 2001/0022238 | A1 | 9/2001 | Houwelingen et al. | |
| 2002/0153169 | A1 | 10/2002 | Sewell | |
| 2003/0196791 | A1 | 10/2003 | Dunn et al. | |
| 2005/0103526 | A1 | 5/2005 | Ayling | |
| 2007/0031215 | A1 | 2/2007 | Belik | |
| 2007/0119623 | A1 | 5/2007 | Sewell et al. | |
| 2007/0240903 | A1 | 10/2007 | Alft et al. | |
| 2009/0095526 | A1 | 4/2009 | Lane et al. | |
| 2013/0240269 | A1 | 9/2013 | Novelo et al. | |

* cited by examiner

PIPE HANDLING ASSEMBLY

SUMMARY

The present disclosure is directed to an apparatus comprising an elongate rotatable shaft, a series of longitudinally spaced and angularly offset stop elements, and a bolt element. The series of stop elements are supported by the shaft. Each of the stop elements has a rotational path of travel. The bolt element is longitudinally positionable so as to block the path of travel of a selected one of the stop elements.

DETAILED DESCRIPTION

Many utility pipelines are installed underground by boring a borehole in a generally-horizontal direction rather than by digging a trench. This type of construction is typically referred to as "horizontal boring" or "horizontal directional drilling". A horizontal borehole is created by using a drilling machine to drive rotation of a drill bit attached to a drill string. The drill string is made of up of a plurality of pipe sections connected together. The pipe sections are stacked in columns within a pipe box attached to the drilling machine.

A carriage included within the drilling machine connects the pipe sections together and pushes or pulls the drill string through the ground, surface.

In operation, a pipe handling assembly uses a pair of shuttle arms to transport each pipe section between the pipe box and the carriage. The shuttle arms are stopped beneath each column using a pipe column selection assembly.

Pipe column selection assemblies known in the art typically include structures attached directly to the shuttle arms. Such systems may comprise stop elements attached to the sides of the shuttle arms that are configured to engage with a vertically adjustable bolt attached to the machine. These systems add extra weight and bulk to the drilling machine. The present disclosure is directed to a pipe column selection assembly that adds minimal structures to the machine.

Figure 1:
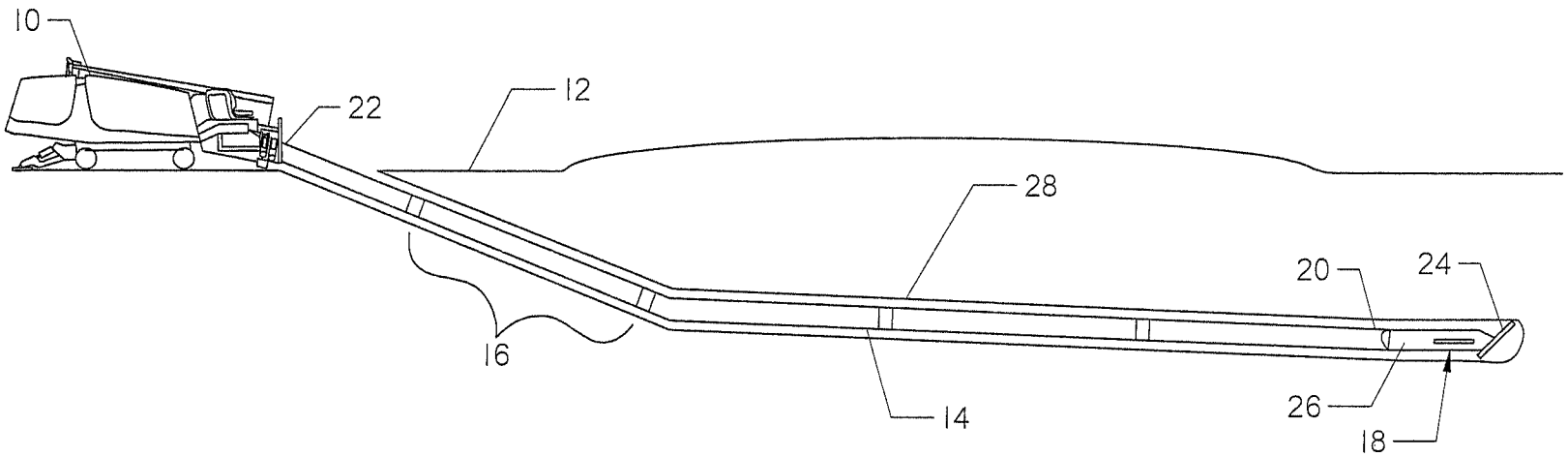
FIG. 1 is an illustration of a horizontal boring operation.

Turning now to the figures, FIG. 1 shows a drilling machine 10 sitting on a ground surface 12. Extending from the drilling machine 10 is a drill string 14. The drill string 14 is made up of a plurality of pipe sections 16 attached end to end. The drill string 14 is connected to a downhole tool 18 at its first end 20 and the drilling machine 10 at its second end 22.

The downhole tool 18 comprises a drill bit 24 and a beacon contained within a beacon housing 26. In operation, the drill bit 24 will bore underground and advance the downhole tool 18 and the drill string 14 forward creating a borehole 28. The drilling machine 10 will add the plurality of pipe sections 16 to the drill string 14 as the downhole tool 18 advances underground.

Figure 2:
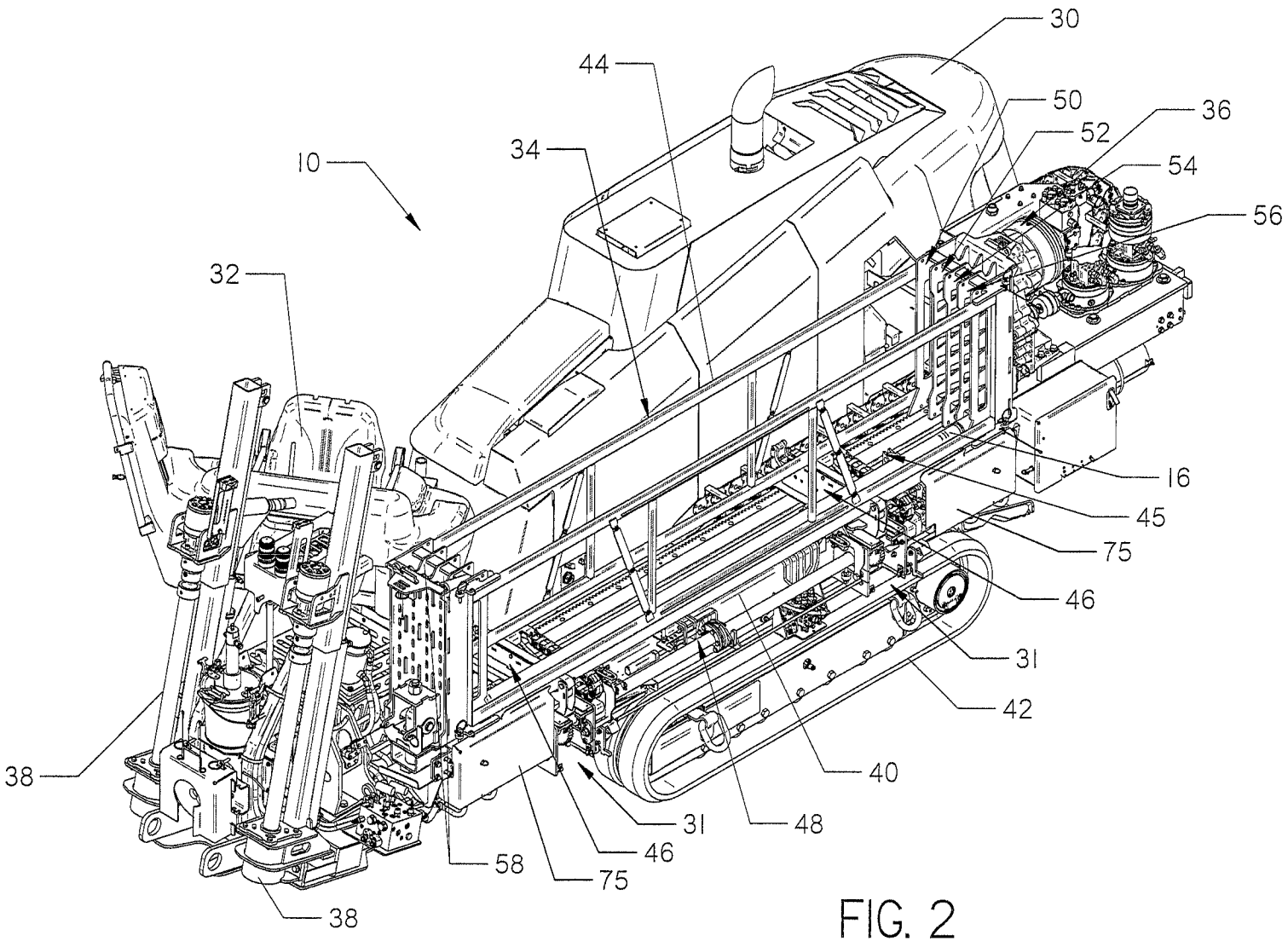
FIG. 2 is left side perspective view of a horizontal boring machine. A pipe section is shown disposed within a pipe box attached to the machine.
Figure 3:
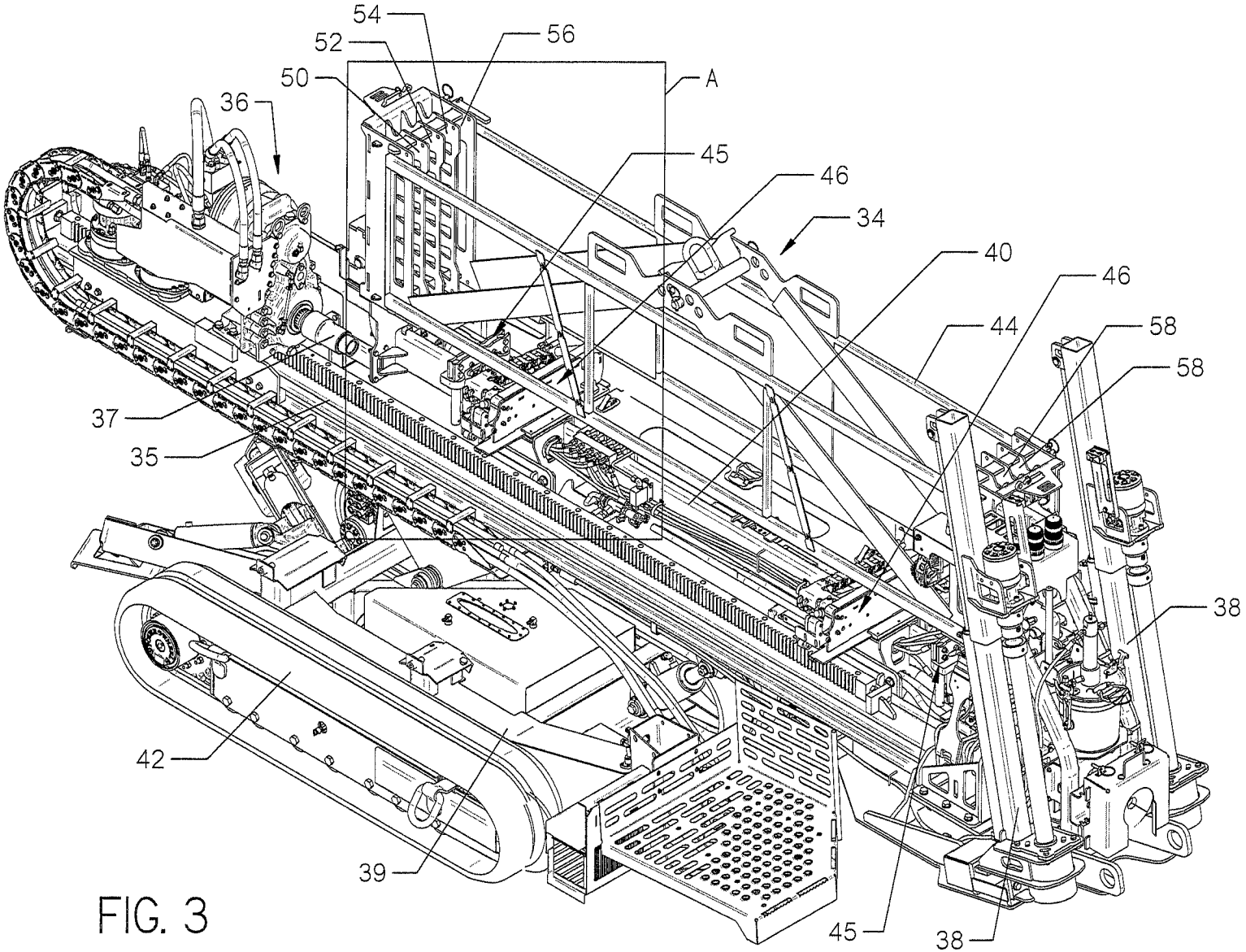
FIG. 3 is a right side perspective view of the horizontal boring machine shown in FIG. 2. The operator station, engine cowl, and pipe section have been removed for clarity.

Turning to FIGS. 2 and 3, the drilling machine 10 comprises an engine housed within an engine compartment 30, an operator station 32, a pipe handling assembly 34, a carriage 36, and a pair of anchor assemblies 38. The components of drilling machine 10 are supported on a machine frame 39 attached to a pair of endless tracks 42, as shown in FIG. 3. The tracks 42 move the machine 10 from location to location. The anchor assemblies 38 anchor the machine 10 into the ground surface 12 during operation.

Continuing with FIG. 3, the carriage 36 uses a rotating spindle 37 to connect pipe sections 16 to or remove pipe sections 16 from the drill string 14. The carriage 36 moves longitudinally along a rail 35 to push and pull the drill string 14 through the ground surface 12.

Figure 4:
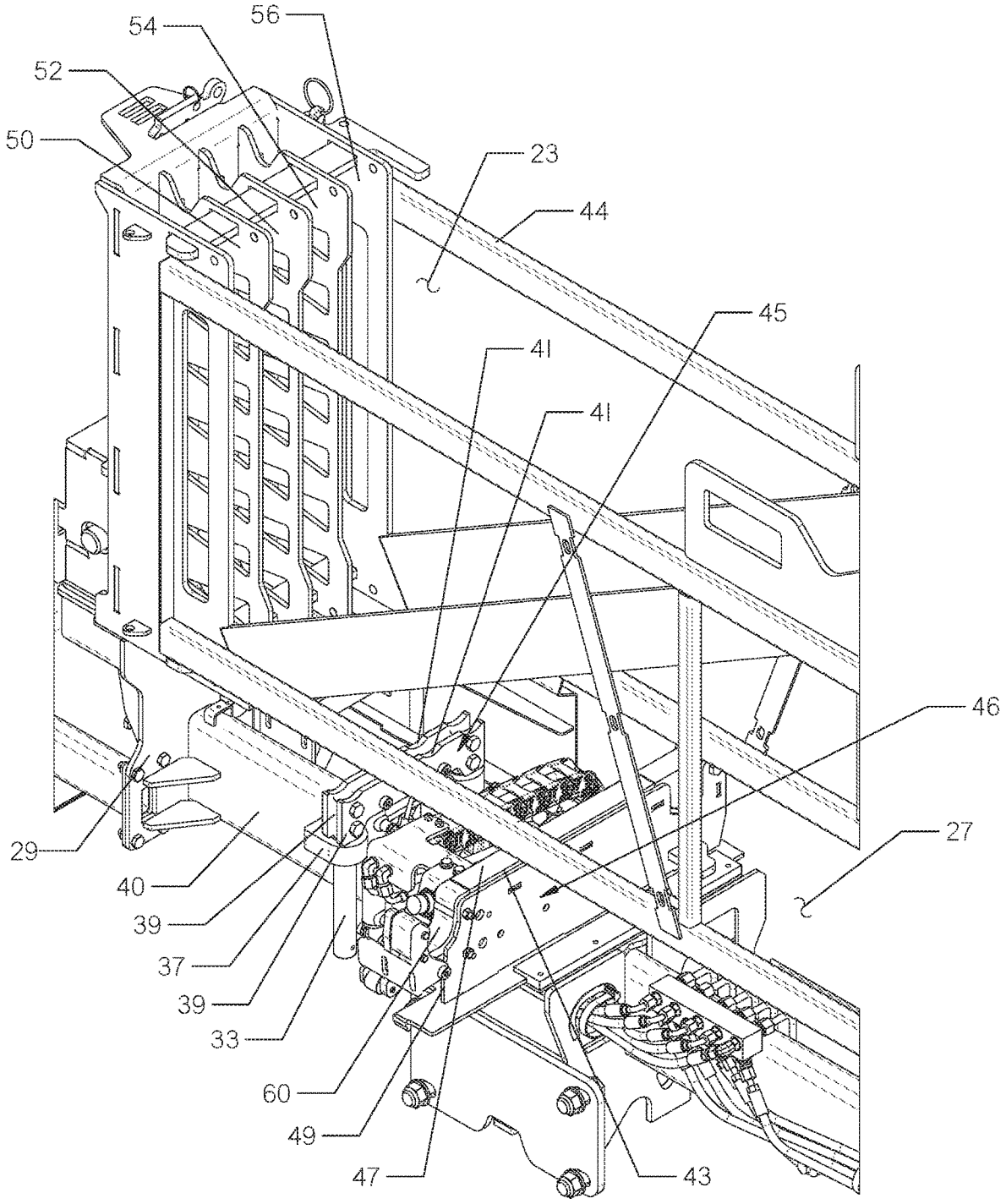
FIG. 4 is an enlarged view of area A shown in FIG. 3, with a portion of a carriage of the machine, omitted.
Figure 5:
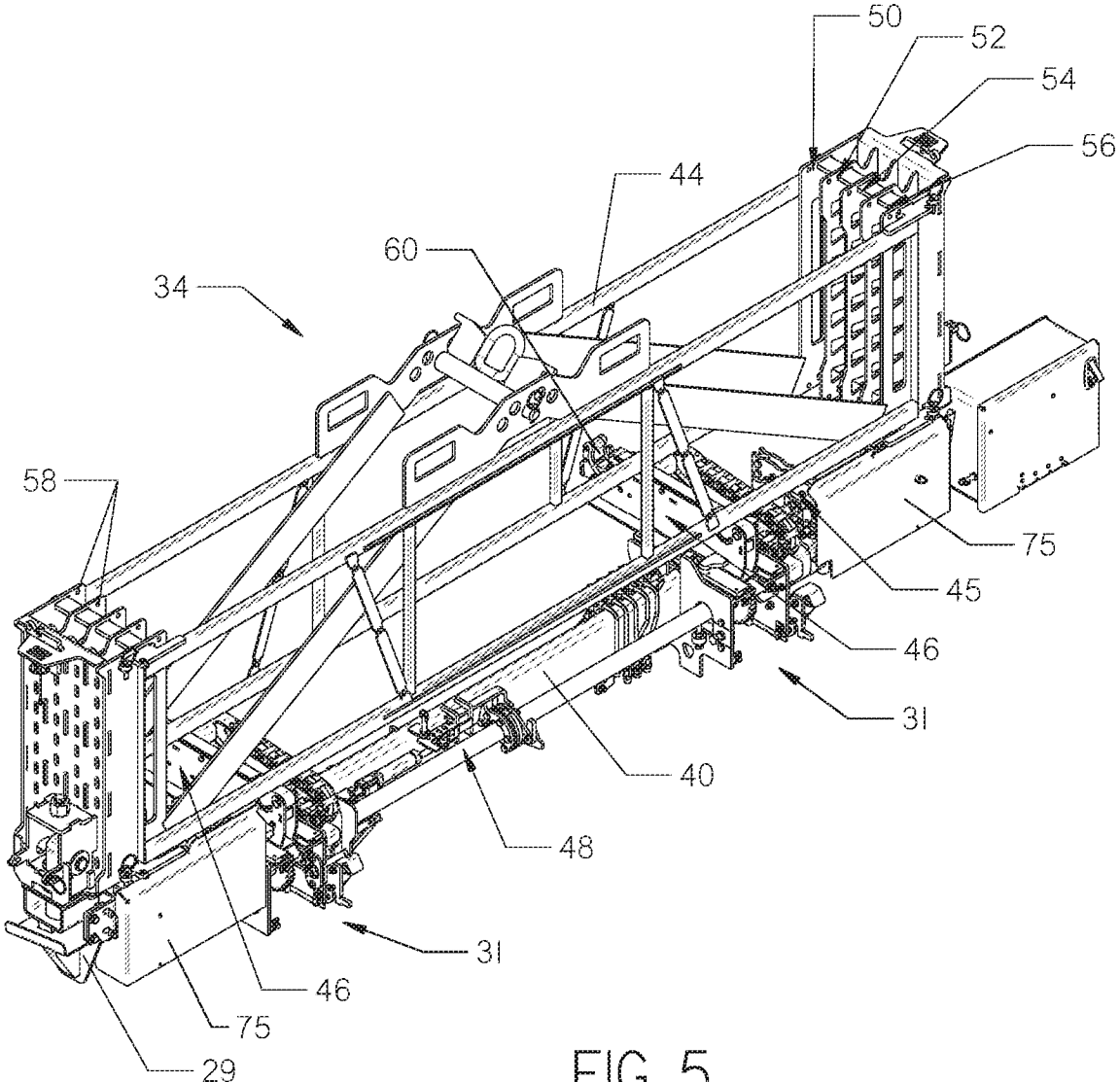
FIG. 5 is a perspective view of a pipe handling assembly of the horizontal boring machine shown in FIG. 2.

With reference with FIGS. 2-5, the pipe handling assembly 34 comprises a pipe box 44, a pair of lift assemblies 45, and a shuttle drive 31. The shuttle drive 31 comprises a pair of shuttle arms 46 and a pipe column selection assembly 48, as shown in FIGS. 2 and 5. The pipe handling assembly 34 is supported on an elongate frame 40 attached to the machine frame 39, as shown in FIG. 3.

The pipe box 44 has the shape of a right rectangular prism and is open on its top and bottom ends 23 and 27, as shown in FIG. 4. The elongate sides are shown open in figures. However, the sides may be covered by side panels to provide a barrier between the pipe sections 16 and persons near the machine 10.

Figure 7:
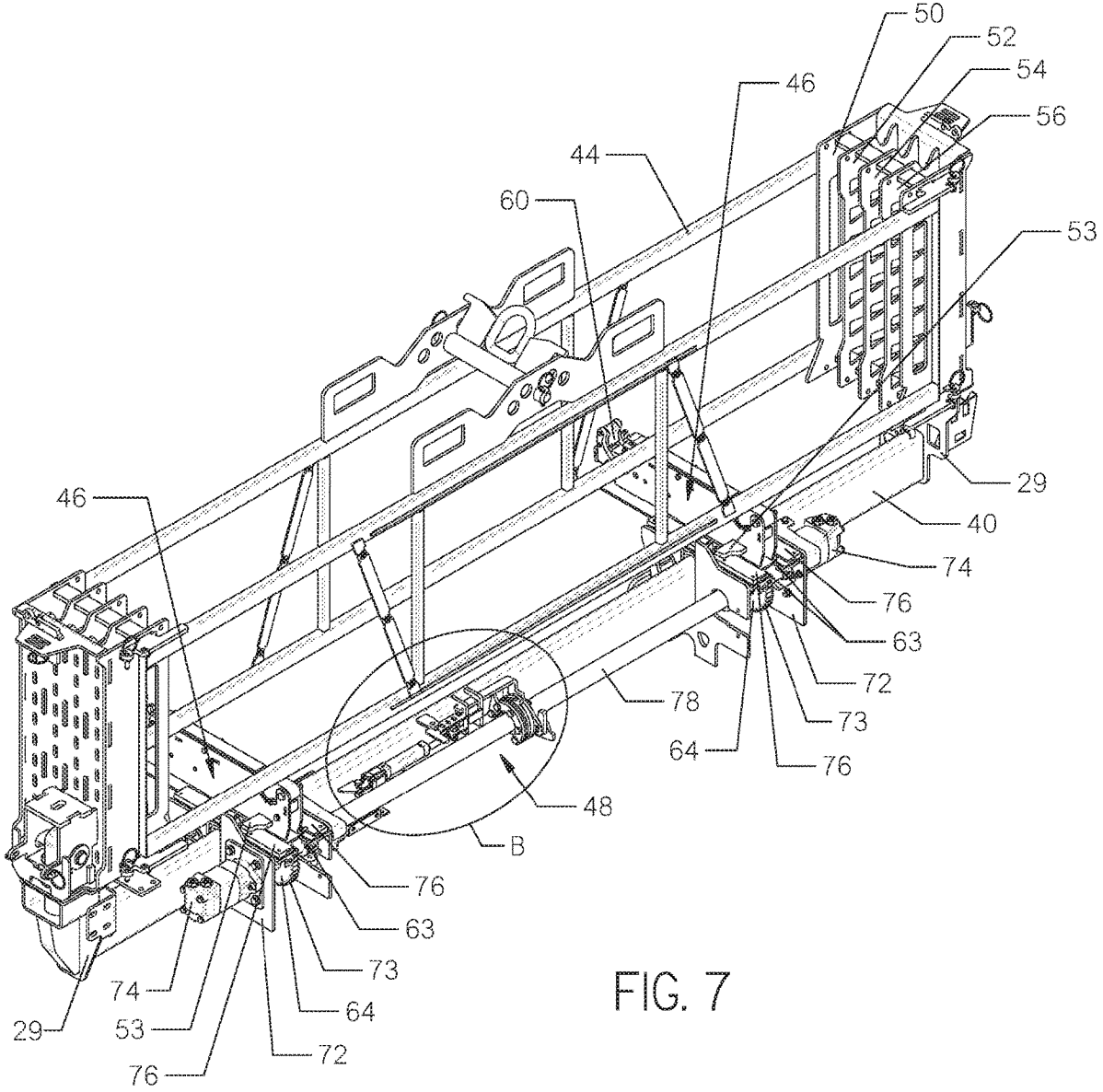
FIG. 7 is the same view as FIG. 5, without the lift assemblies, and other components attached to the frame, omitted. The shuttle arms are shown in the operating position.

The pipe box 44 is supported on the frame 40 by brackets 29 attached to opposite ends of the frame 40, as shown best in FIG. 7. A plurality of dividers 58 are positioned at opposite ends of the interior of the pipe box 44. The dividers 58 create four columns within the pipe box 44—a first column 50, a second column 52, a third column 54, and a fourth column 56. The pipe sections 16 are loaded into the columns 50, 52, 54, and 56 within the pipe box 44. For reference, a pipe section 16 is shown positioned within the fourth column 56 in FIG. 2.

With reference to FIGS. 3 and 4, the lift assemblies 45 transport pipe sections 16 between the pipe box 44 and the shuttle arms 46. The lift assemblies 45 are supported on the frame 40 directly beneath the pipe box 44 such that they are parallel to and spaced apart from one another. The lift assemblies 45 are movable vertically between a lowered position, adjacent the frame 40, and a raised position, adjacent the bottom end 27 of the pipe box 44. When in a raised position, the lift assemblies 45 support the pipe sections 16 and hold them within the pipe box 44. The pipe sections 16 lower with the lift assemblies 45 as they move to a lowered position.

Continuing with FIG. 4, the lift assemblies 45 comprise a pair of hydraulic cylinders 33 attached to a pair of elongate parallel plates 39. The cylinders 33 move the plates 39 between the raised and lowered positions. The plates 39 extend the width of the pipe box 44. A set of notches 41 are formed in the plates 39 directly below each column 50, 52, 54, and 56. The notches 41 are configured to closely receive the outer surface of each pipe section 16.

Figure 6:
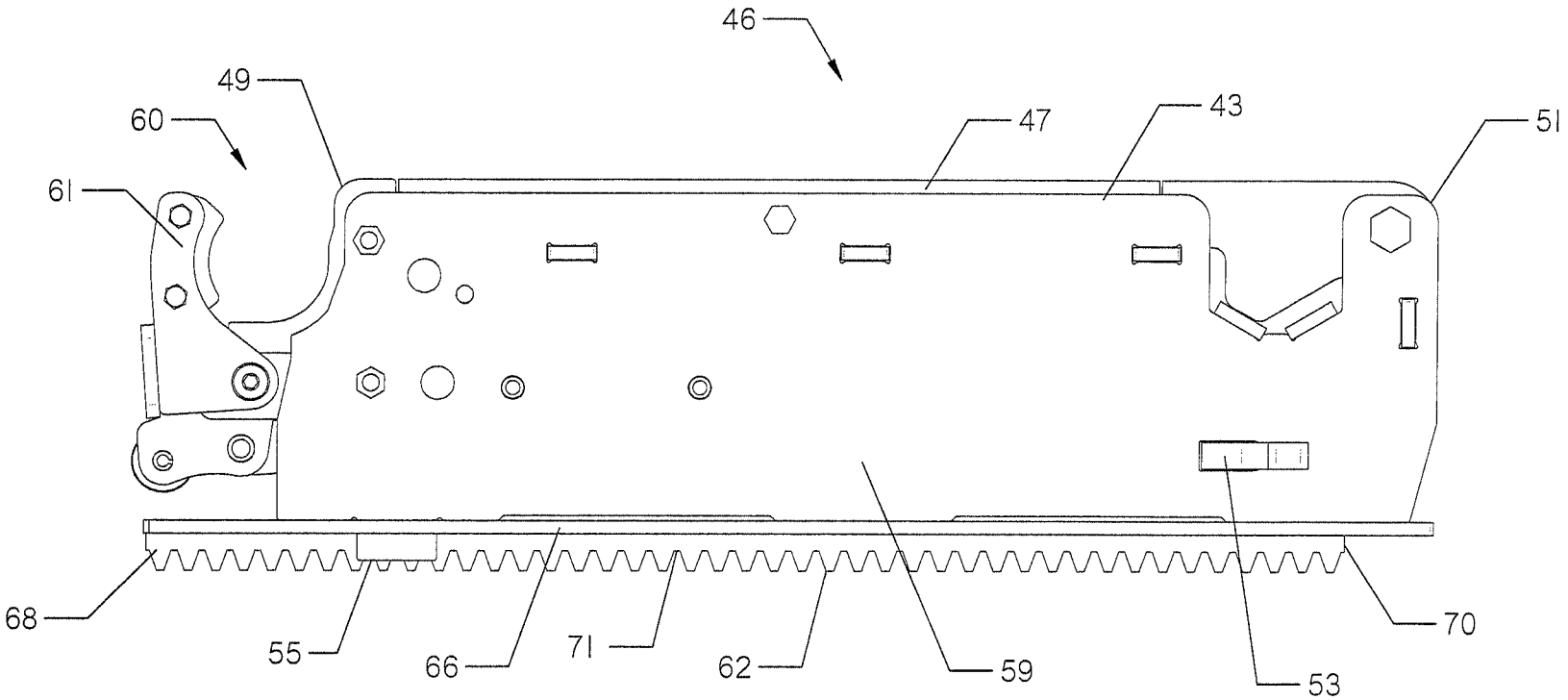
FIG. 6 is a side view of a shuttle arm of the pipe handling assembly shown in FIG. 5.

With reference to FIGS. 3, 4 and 6, the shuttle arms 46 transport the pipe sections 16 between the lift assemblies 45 and the carriage 36. The shuttle arms 46 are supported on the frame 40 parallel to and spaced apart from one another and adjacent to one of the lift assemblies 45. The shuttle arms 46 are movable along an axis that is perpendicular to a longitudinal axis of the frame 40.

Each of the shuttle arms 46 comprises an elongate body 59 having a gripper 60 formed at its first end 49. The grippers 60 each comprise an arm 61 configured to move towards and away from the body 59. The grippers 60 are configured to releasably hold a pipe section 16 via movement of the arms 61.

Each shuttle arm 46 further comprises a shuttle pad 47 attached to its upper side 43 and extending along its length, as shown in FIGS. 4 and 6. The shuttle pads 47 provide a surface to support pipe sections 16 that are lowered from the pipe box 44 by the lift assemblies 45.

With reference to FIGS. 6 and 7, the shuttle arms 46 are moved using a rack 62 and a pinion gear 64. Each of the shuttle arms 46 includes a rack 62, which is an elongate metal structure either formed in or attached to the lower side 66 of the shuttle arm 46. Each rack 62 extends between forward and rearward ends 68 and 70, and preferably extends along the greater part of the length of its associated shuttle arm 46. A plurality of longitudinally aligned grooves 71 are formed in the underside of each rack 62.

Each pinion gear 64 is mounted on the frame 40 beneath a corresponding shuttle arm 46, as shown in FIG. 7. Each pinion gear 64 is supported by a bracket 72, which is in turn supported on the frame 40. A plurality of teeth 73 are formed around the outer periphery of each pinion gear 64. The grooves 71 of each rack 62 mate with the teeth 73 of each pinion gear 64. Rotation of each pinion gear 64 causes each shuttle arm 64 to move longitudinally relative to the frame 40.

The pinion gears 64 are interconnected by a shaft 78 that extends parallel to the longitudinal axis of the frame 40 between the gears. The shaft 78 rotationally locks the pinion gears 64 together so that the shuttle arms 46 move in unison.

Each of the shuttle arms 46 is positioned between guides 76 mounted to the frame 40, on one side, and the brackets 72, on the other side. A pair of hydraulic motors 74 are supported on the frame 40, with each motor 74 drivingly engaging a corresponding one of the pinion gears 64. The motors 74 operate simultaneously, with each driving rotation of its associated pinion gear 64. The motors 74 may each be protected by a motor cover 75, as shown in FIGS. 2 and 5.

The pinion gears 64 may rotate in a clockwise or counter-clockwise direction. Clockwise rotation of the pinion gears 64 moves the shuttle arms 46 rearwardly away from the carriage 36. Counter-clockwise rotation of the pinion gears 64 moves the shuttle arms 46 forward towards the carriage 36.

The shuttle arms 46 also include front stops 53 and rear stops 55. The front stops 53 are tabs attached to opposite sides of the shuttle arms 46 adjacent its rear end 51. The tabs project from the sides of the shuttle arms 46, as shown in FIG. 5. A front edge of each of the tabs is configured to engage with a longitudinally adjustable bolt 57 supported on each of the guide members 76, as shown best in FIG. 10. Engagement of the front stops 53 with the bolts 57 stops movement of the shuttle arms in an operating position, as explained in more detail below.

The rear stops 55 are formed on the lower side 66 of each shuttle arm 46 and comprise two tabs positioned on opposite sides of the rack 62. The rear stops 55 are configured to engage with ledges 63 formed at a rear end of the guides 76, as shown best in FIG. 7. The rear stops 55 engage with the ledges 63 as the shuttle arms 46 move rearwardly and stop movement of the shuttle arms 46. Such engagement stops movement of the shuttle arms 46 at a fourth column arm position, as discussed in more detail below.

Figure 10:
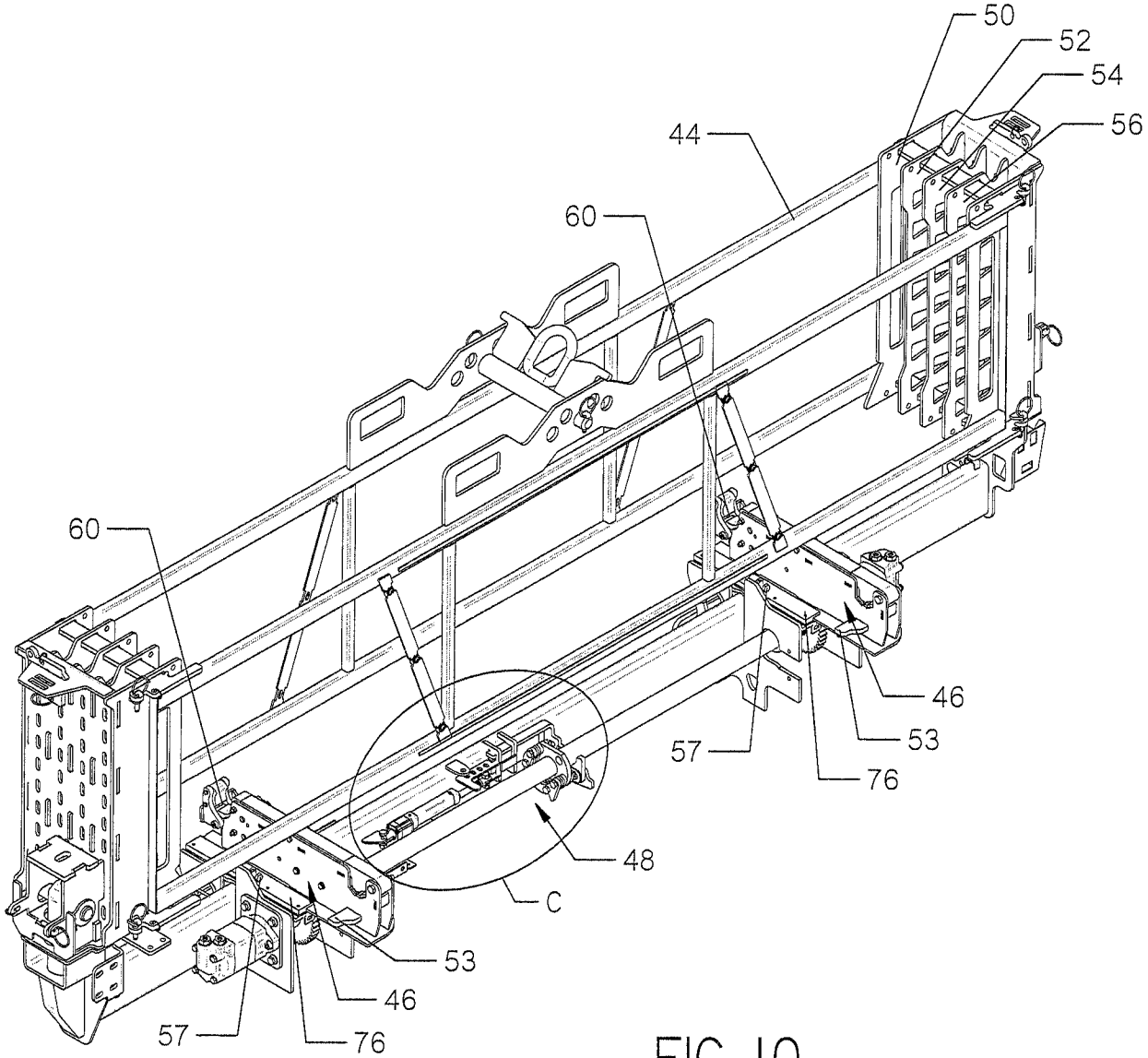
FIG. 10 is the same view as FIG. 7, but with the shuttle arms moved to the first column arm position.

With reference to FIGS. 3 and 4, to unload pipe sections 16 from the first column 50, the lift assemblies 45 are initially in the raised position, holding the pipe sections 16 within the pipe box 44. The shuttle arms 46 are positioned so that each of the grippers 60 is directly beneath the first column 50, as shown in FIG. 10. Once the grippers 60 are in position, the lift assemblies 45 are moved to a lowered position. The pipe sections 16 in the pipe box 44 will lower with the lift assemblies 45. The lift assemblies 45 move lower than the height of the shuttle arms 46 when moving to the lowered position. Thus, the path of travel of the pipe sections 16 is interrupted by the shuttle arms 46 as the lift assemblies 45 lower. Such interruption causes the pipe section 16 from the first column 50 to lower into the grippers 60, and the pipe sections 16 from the second, third, and fourth columns 52, 54, and 56 to lower onto the shuttle pads 47.

Once a pipe section 16 is securely held in the grippers 60, the shuttle arms 46 will move slightly forward so the grippers 60 clear a front edge 37 of the lift assemblies 45, as shown in FIG. 4. The shuttle arms 46 will slide underneath the pipe sections 16 resting on the shuttle pads 47 as the shuttle arms 46 move forward. The rails surrounding the bottom end 27 of the pipe box 44 and the dividers 58 will prevent the pipe sections 16 resting on the shuttle pads 47 from moving with the shuttle arms 46. Once the grippers 60 holding the pipe section 16 have cleared the lift assemblies 45, the lift assemblies 45 will move to their raised positions. Pipe sections 16 remaining within the pipe box 44 will be raised as the lift assemblies 45 are raised.

When unloading pipe sections 16 from the pipe box 44, the first column 50 must be completely unloaded before moving to the second column 52, and so on. Otherwise, pipe sections 16 would fall from the pipe box 44 as the lift assemblies 45 move to the lowered position.

Figure 19:
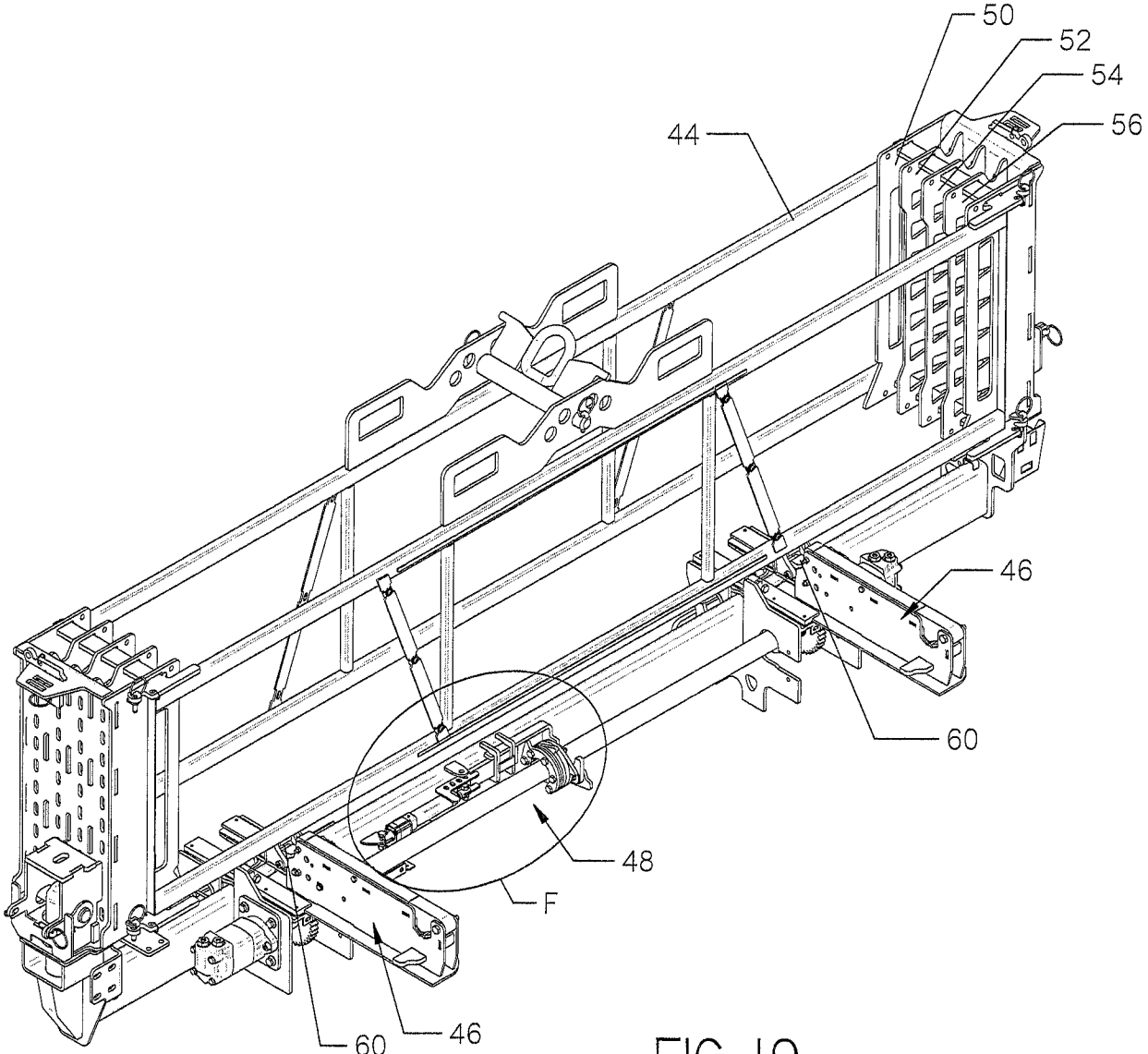
FIG. 19 is the same view as FIGS. 7, 10, 13 and 16, but with the shuttle arms moved to the fourth column arm position.

To load pipe sections 16 into the pipe box 44, the lift assemblies 45 are initially in a lowered position. The shuttle arms 46 retrieve a pipe section 16 from the carriage 36 and move rearwardly so that the grippers 60 are positioned directly beneath the fourth column 56, as shown in FIG. 19.

Once the pipe section 16 is directly beneath the fourth column 56, the lift assemblies 45 will move to a raised position and pick up the pipe section 16 along the way. The shuttle arms 46 will then move forward and retrieve another pipe section 16 from the carriage 36.

Once a new pipe section 16 is in the grippers 60, the lift assemblies 45 will move to a lowered position so that the pipe section 16 within the fourth column 56 rests on the shuttle pads 47. The shuttle arms 46 will then move rearwardly, sliding underneath the pipe section 16 resting on the shuttle pads 47. Once the grippers 60 reach a position beneath the fourth column 56, the pipe section 16 on the shuttle pads 47 will fall on top of the pipe section 16 held within the grippers 60. The lift assemblies 45 are then moved to a raised position, lifting both of the pipe sections 16 into the fourth column 56. The shuttle arms 46 may then move forward to retrieve another pipe section 16 from the carriage 36. This process continues until the fourth column 56 is full of pipe sections 16.

When loading pipe sections 16 into the pipe box 44, the fourth column 56 must be completely filled before moving to the third column 54, and so on. Otherwise, pipe sections 16 would fall from the pipe box 44 as the lift assemblies 45 move to a lowered position.

With reference to FIGS. 5 and 7, movement of the shuttle arms 46 is controlled by the pipe column selection assembly 48. The assembly 48 regulates the movement of the shuttle arms 46 between a plurality of arm positions. Each arm position corresponds with a selected one of the columns 50, 52, 54, and 56.

Figure 13:
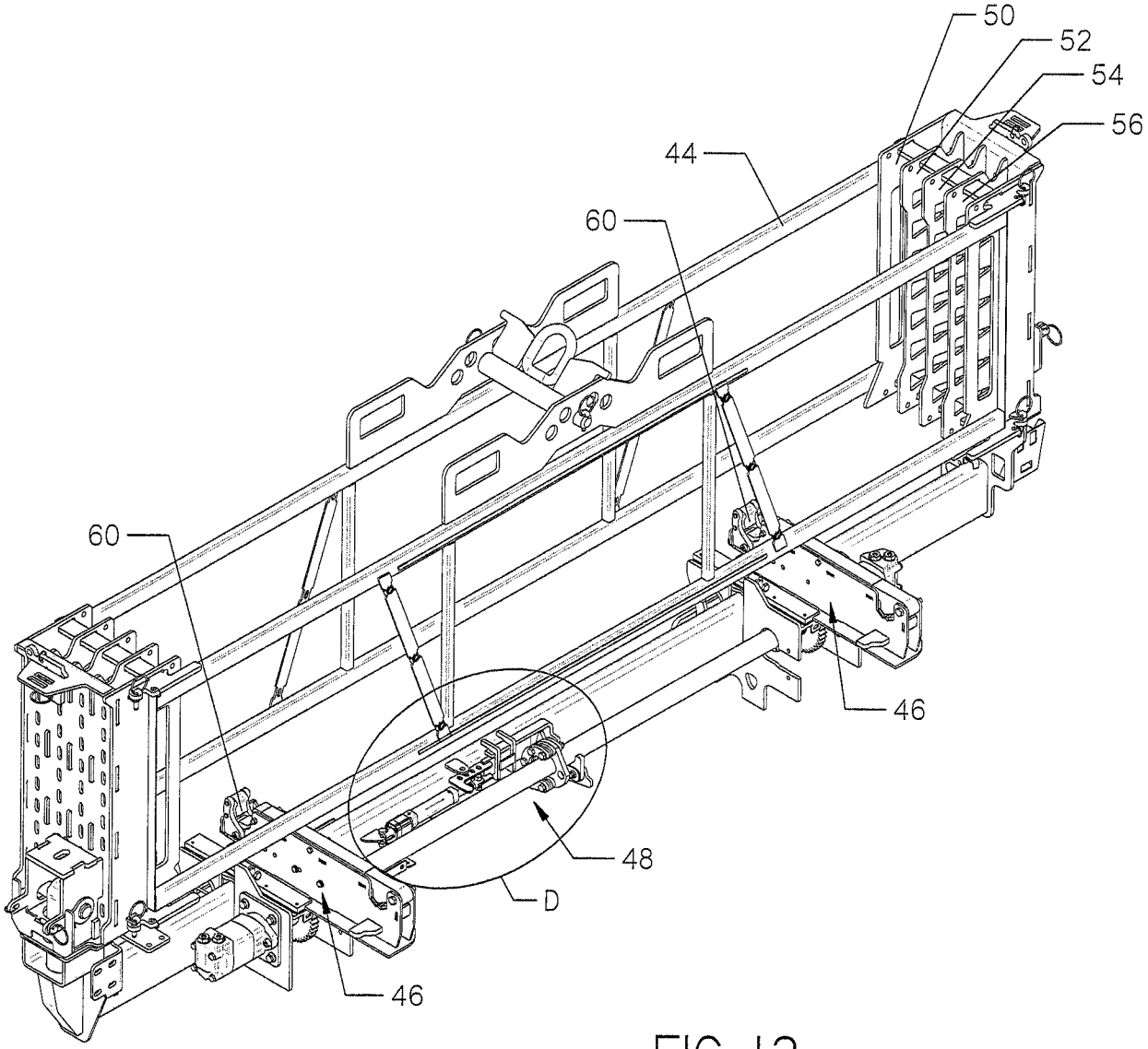
FIG. 13 is the same view as FIGS. 7 and 10, but with the shuttle arms moved to the second column arm position.
Figure 16:
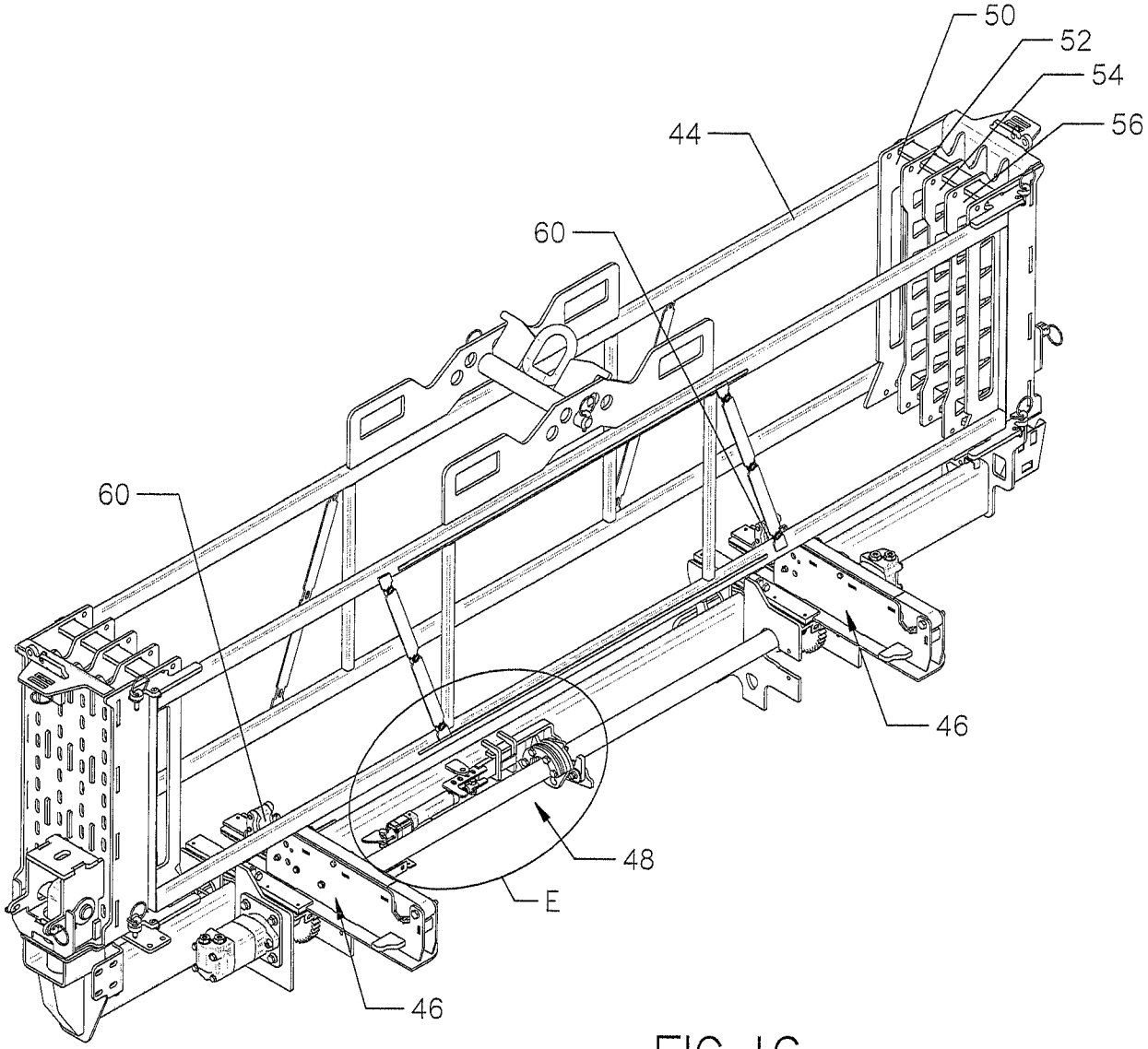
FIG. 16 is the same view as FIGS. 7, 10 and 13, but with the shuttle arms moved to the third column arm position.

In a first column arm position, the grippers 60 of the shuttle arms 46 are positioned directly below the first column 50, as shown in FIG. 10. In a second column arm position, the grippers 60 are positioned directly below the second column 52, as shown in FIG. 13. In a third column arm position, the grippers 60 are positioned directly below the third column 54, as shown in FIG. 16. Finally, in a fourth column arm position, the grippers 60 are positioned directly below the fourth column 56, as shown in FIG. 19.

The shuttle arms 46 are also moveable to an operating position, as shown in FIGS. 2-5 and 7. When in the operating position, the shuttle arms 46 hold a pipe section 16 in line with the spindle 37 of the carriage 36, as shown in FIG. 3. As discussed above, the front stops 53 stop movement of the shuttle arms 46 once the arms reach the operating position. The bolts 57, shown in FIG. 10, may be longitudinally adjusted so as to accurately place the pipe section 16 in line with the spindle 37.

Figure 8:
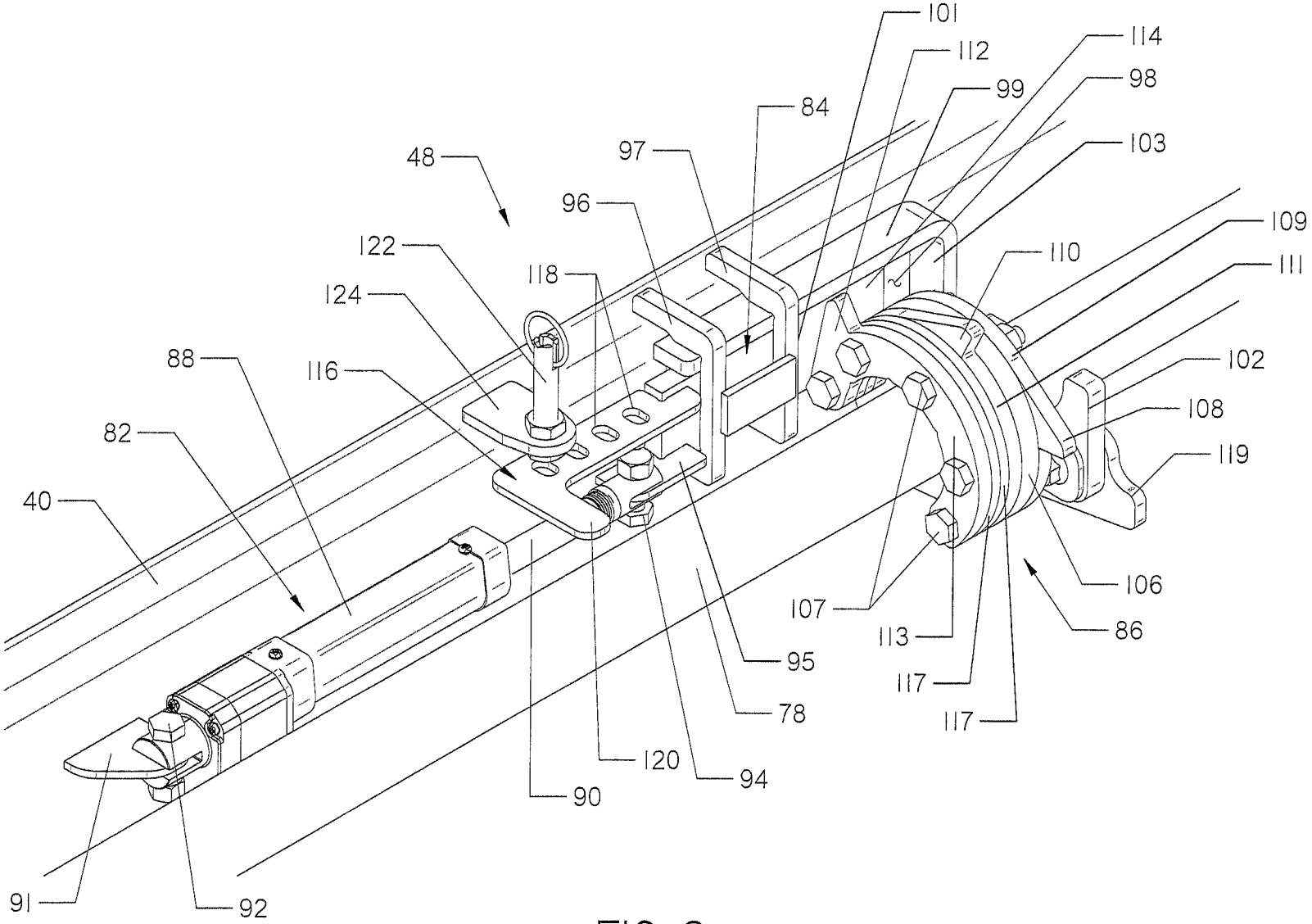
FIG. 8 is an enlarged view of area B shown in FIG. 7.
Figure 9:
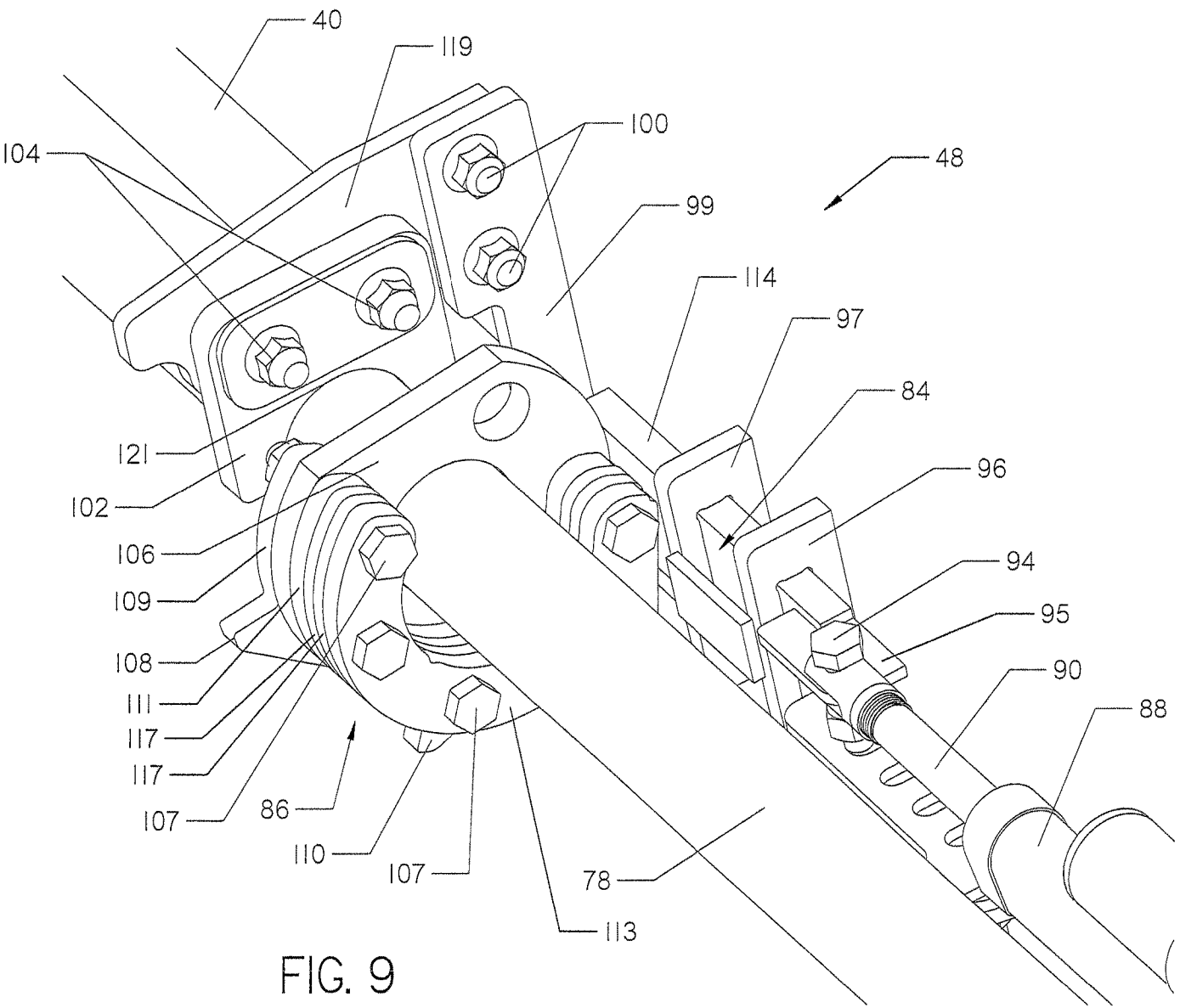
FIG. 9 is a bottom perspective view of a portion of the pipe column selection assembly shown in FIG. 8.

Turning to FIGS. 7-9, the pipe column selection assembly 48 comprises a plurality of stop elements 86 supported on the already existing shaft 78. Each stop element 86 is longitudinally spaced from its adjacent stop element or elements, and rotates in unison with the shaft 78. As the shaft 78 rotates, each stop element 86 is characterized by a unique rotational path of travel.

The stop elements 86 preferably comprise a plurality of flat metal plates. In the embodiment shown in the figures, the plates are three in number, and designated by reference numerals 109, 111, and 113. Each plate is preferably shaped as an unclosed loop. Each plate at least partially surrounds the shaft 78 and has a single hook 108, 110, and 112 projecting from its outer edge. Each hook 108, 110, and 112 has a triangular shape. However, the hooks may also have the shape of an oval, circle, or polygon.

Each of the hooks 108, 110, and 112 is formed at a position that is angularly offset from the position of the hook of each adjacent plate. The angular spacing between adjacent hooks matches the angle through which the pinion gear 64 must rotate to move the shuttle arms 46 between adjacent columns. The number of stop elements 86 should equal the number columns in the pipe box 44, less one. Thus, if a pipe box has three columns, the assembly may only comprise two stop elements.

In alternative embodiments, the hooks may be formed at the same position on each plate. In such case, the plates themselves may be supported on the shaft 78 at angularly offset positions so that the hooks are offset from one another. The plates may also have the shape of a circle and completely surround the shaft 78. In further alternative embodiments, the stop elements may not comprise plates. For example, the stop elements may be longitudinally spaced and angularly offset hooks projecting from the surface of the shaft.

The shaft 78 and the stop elements 86 are preferably formed as separate pieces. The stop elements 86 are secured to a mount 106 by a plurality of bolts 107. The mount 106 is a planar structure rigidly supported on the shaft 78. The mount 106 may be held in place on the shaft 78 by friction or by welding. In the embodiment shown in the figures, the mount 106 is positioned between plates 109 and 111. One or more spacers 117 may be positioned between adjacent plates, as needed to establish and maintain uniform plate spacing. In alternative embodiments, the stop elements may be directly welded to the shaft, thereby forming a single piece.

Continuing with FIGS. 8 and 9, the pipe column selection assembly 48 further comprises a bolt element 84 supported on the frame 40. The bolt element 84 is an elongate metal bar having a rectangular cross-sectional shape. In alternative embodiments, the bolt element may have different cross-sectional shapes, such as an oval, circle or other polygon.

The bolt element 84 is characterized by a free end section 114, and is longitudinally movable relative to the frame 40 such that the end section 114 may enter and leave a stop zone 98. The stop zone 98 is bounded by a first end 101 and an opposed second end 103. Within the stop zone 98 the end section 114 of the bolt element 84 may move longitudinally between its boundaries. In the embodiment shown in the figures, a medial portion of the bolt element 84 extends though aligned eyes formed in a spaced pair of brackets 96 and 97. The stop zone 98 is bounded by the bracket 97 and by the upright portion of a L-shaped structural element 99. The bracket 97 coincides with the first end 101 and the upright portion coincides with the second end 103.

Figure 12:
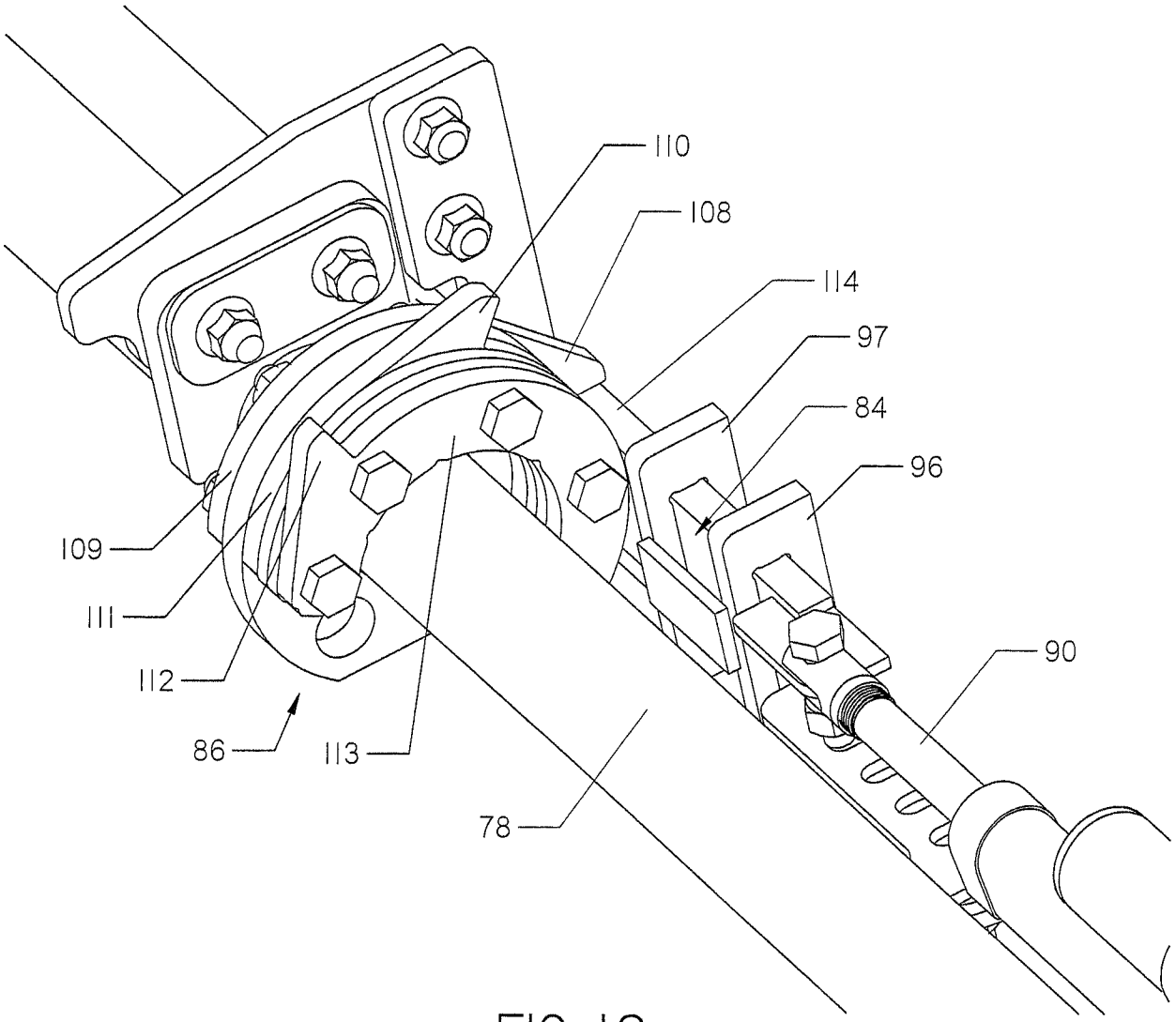
FIG. 12 is a bottom perspective view of a portion of the pipe column selection assembly shown in FIG. 11.

The shaft 78 is positioned such that the stop elements 86 and the stop zone 98 are in face-to-face relationship. As the shaft 78 rotates, the stop elements 86 travel through the stop zone 98. By longitudinal movement of the bolt element 84, the end section 114 may be positioned within the stop zone 98 so as to block the path of travel of a selected one of the stop elements 86. The rotating hook of the selected one of the stop elements 86 strikes the end section 114 of the bolt element 84, and rotation of the shaft 78 is blocked. One example of this phenomenon is depicted in FIG. 12, which shows the bolt element 84 blocking the hook 108. The bolt element 84 does not block the path of travel of any stop element 86 situated nearer the second end 103 of the stop zone 98 than the selected stop element.

If one of the hooks 108, 110, 112 engages the end section 114 of the bolt element 84, such engagement will prevent the shaft 78 from turning, which will prevent the pinion gears 64 from turning. If the pinion gears 64 stop turning, the shuttle arms 46 will stop moving. As mentioned, the angular spacing between adjacent hooks matches the angle through which the pinion gear 64 must rotate to move the shuttle arm 46 between adjacent columns. Thus, engagement of a selected stop element 86 with the bolt element 84 stops movement of the shuttle arms 46 at a selected arm position.

Continuing with FIGS. 8 and 9, the element 99 has an edge that extends downward past the shaft 78. A support member 119 is attached to the edge of the element 99 via bolts 100. The support member 119 projects outward away from the frame 40. A shaft stop 102 is attached to the support member 119 via bolts 104. The support member 119 provides support for the shaft stop 102. The shaft stop 102 is a plate with a cut-out 121. The cut-out 121 is shaped to match the shape of the shaft 78. The shaft 78 may be positioned within the cut-out 121. The shaft stop 102 helps support the shaft 78 during operation. The shaft stop 102 may take on different shapes or sizes, as desired. For example, the shaft stop 102 may be secured directly to the element 99 and the support member 119 may be removed.

Longitudinal movement of the bolt element 84 is controlled by an attached actuator. The actuator may be electric, hydraulic or mechanical. The embodiment shown in FIG. 8 includes both an electric actuator 82 and a mechanical actuator 116. The mechanical actuator 116 is provided as back up, for use in the event of failure of the electric actuator 82.

The electric actuator 82 comprises a housing 88 and a rod 90. The housing 88 is secured to a tab 91 via a bolt 92, and the tab 91 is attached to the frame 40. The rod 90 is bolted to a tab 95 via a bolt 94. The tab 95 is welded to the bolt element 84. In alternative embodiments, the rod may be welded to the bolt element. Retraction and extension of the rod 90 from the housing 88 moves the bolt element 84 longitudinally within the stop zone 98.

The mechanical actuator 116 comprises a flat elongate handle 120 that has four equally spaced holes 118 formed along its length. The handle 120 is welded to the bolt element 84. In alternative embodiments, the handle may be bolted to a tab secured to the bolt element. The bolt element 84 is moved longitudinally by pulling or pushing the handle 120.

A pin 122 is positioned above the handle 120 and supported within in a tab 124 that is secured to the frame 40. The pin 122 may be pushed downward and pass through one of the holes 118, so as to secure the handle 120 and the bolt element 84 in place. Each hole 118 corresponds with an arm position. The hole 118 furthest from the bracket 96 corresponds with the first column arm position, and the hole 118 closest to the bracket 96 corresponds with the fourth column arm position.

The pipe column selection assembly 48 is shown exposed in the figures. However, a cover may be positioned over the assembly 48 in order to protect the assembly during operation. A pair of shuttle guards may also be attached to the pipe handling assembly 38 so as to provide a barrier between the moving shuttle arms 46 and any persons near the machine.

In operation, the pipe column selection assembly 48 is controlled via controls at the operator station 32, shown in FIG. 2. To build a drill string 14, an operator will connect all of the pipe sections 16 from the first column 50, before moving to the second column 52, and so on. To retrieve pipe sections 16 from the first column 50, the operator directs the assembly 48 to move the shuttle arms 46 from the operating position to the first column arm position.

Figure 11:
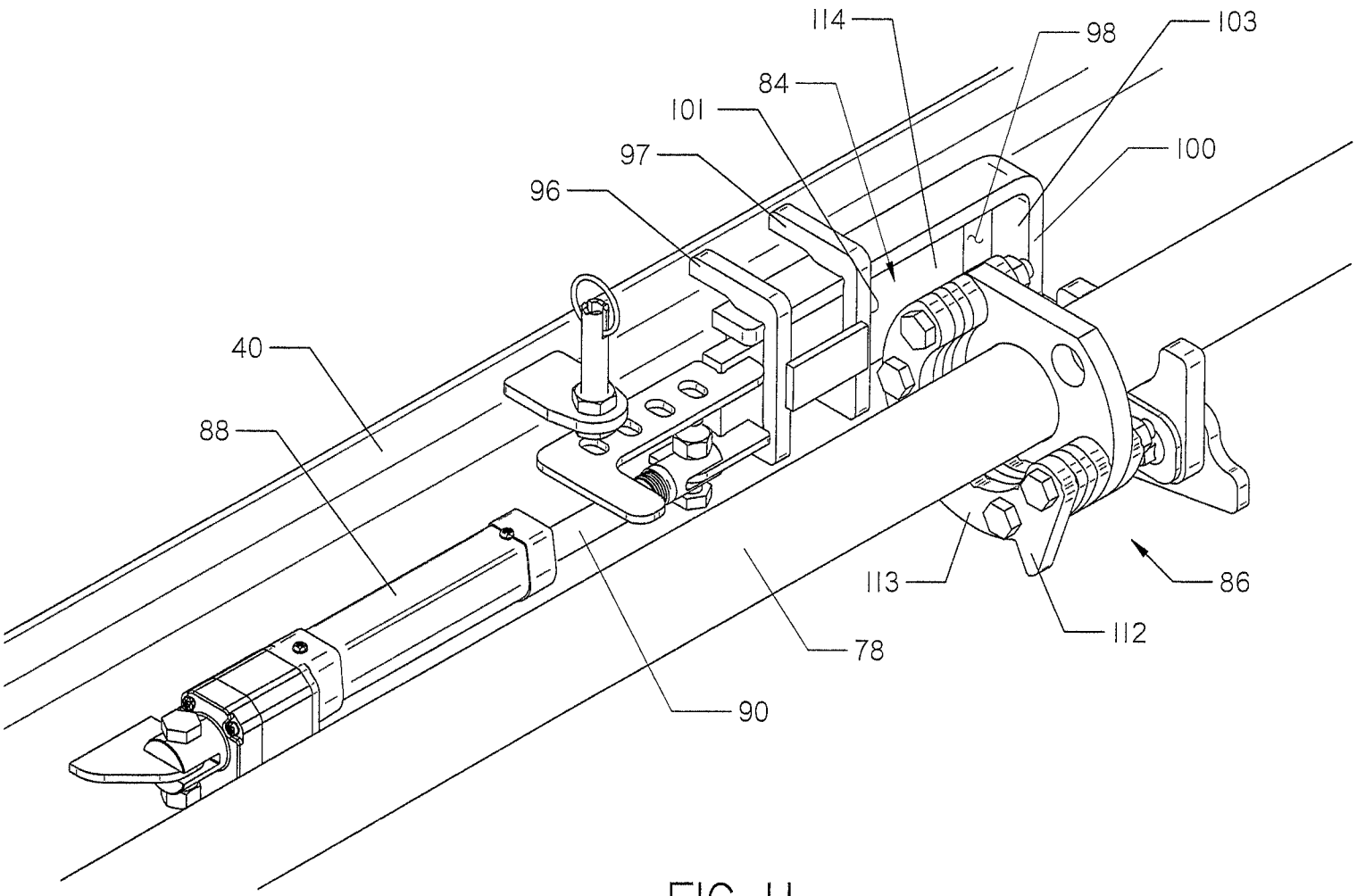
FIG. 11 is an enlarged view of area C shown in FIG. 10.

With reference to FIGS. 10-12, the assembly 48 moves the shuttle arms 46 to the first column arm position by pushing the end section 114 of the bolt element 84 to immediately adjacent the second end 103 of the stop zone 98. The bolt element 84 is moved to this position by extending the rod 90, as shown in FIG. 1*i*. As the shaft 78 and pinion gears 64 rotate clockwise, the first hook 108 will engage the end section 114 of the bolt element 84, as shown in FIG. 12. Such engagement blocks the rotational path of travel of the first hook 108 and stops movement of the shuttle arms 46 at the first column arm position. The lift assemblies 45 will then lower and deliver a pipe section 16 to the grippers 60.

Once the shuttle arms 46 have retrieved the pipe section 16, the shaft 78 and pinion gears 64 will rotate counter-clockwise to return the shuttle arms 46 to the operating position, as shown in FIG. 7. The bolt element 84 does not need to be removed from the stop zone 98 to return the shuttle arms 46 to the operating position. Rather, the spacing of the hooks 108, 110, 112 allows the stop elements 86 to rotate counter-clockwise from each arm position to the operating position without contacting the bolt element 84. Once the first column 50 is empty, the operator may direct the assembly 48 to move the shuttle arms 46 to the second column arm position.

Figure 14:
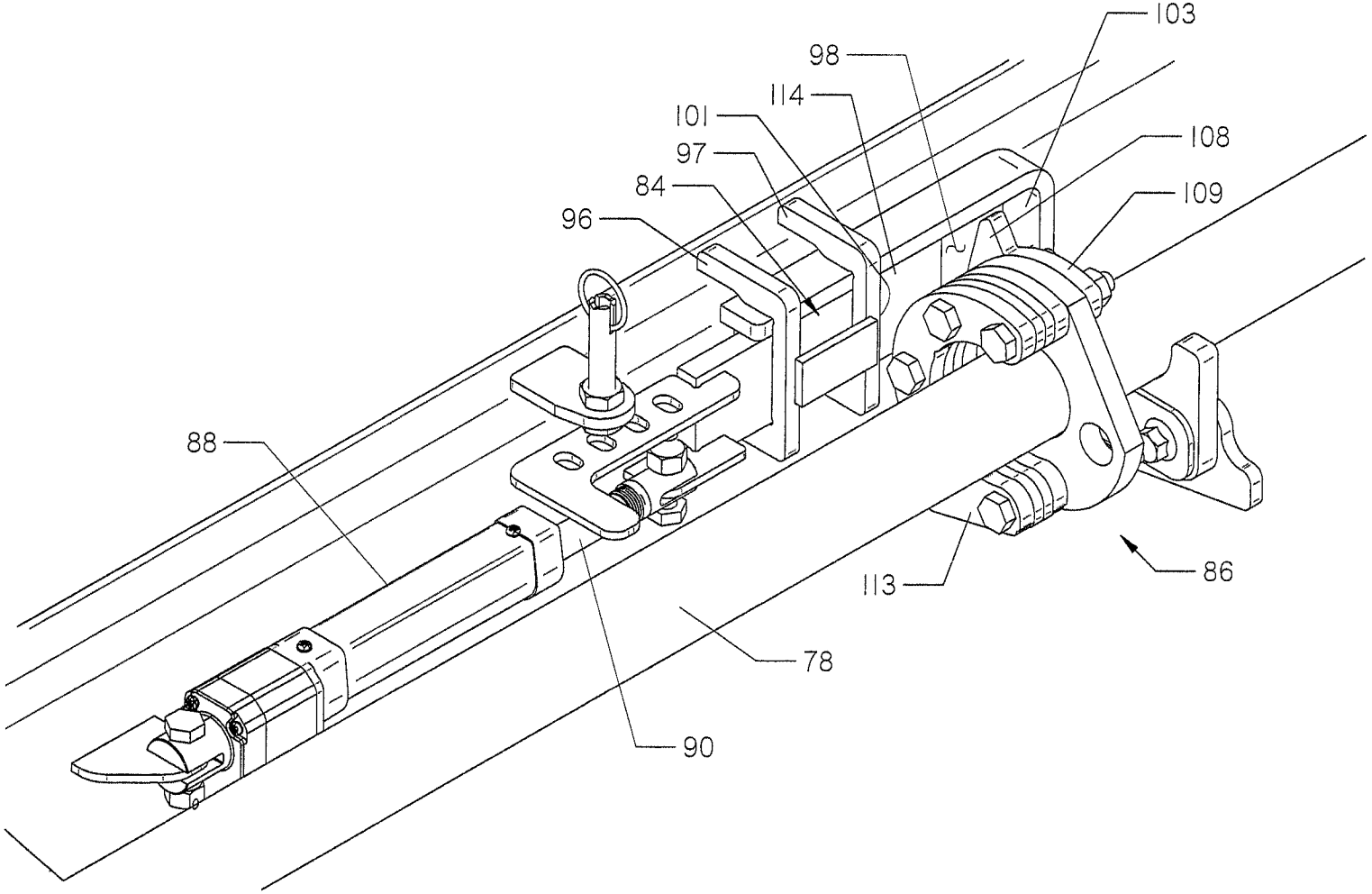
FIG. 14 is an enlarged view of area D shown in FIG. 13.
Figure 15:
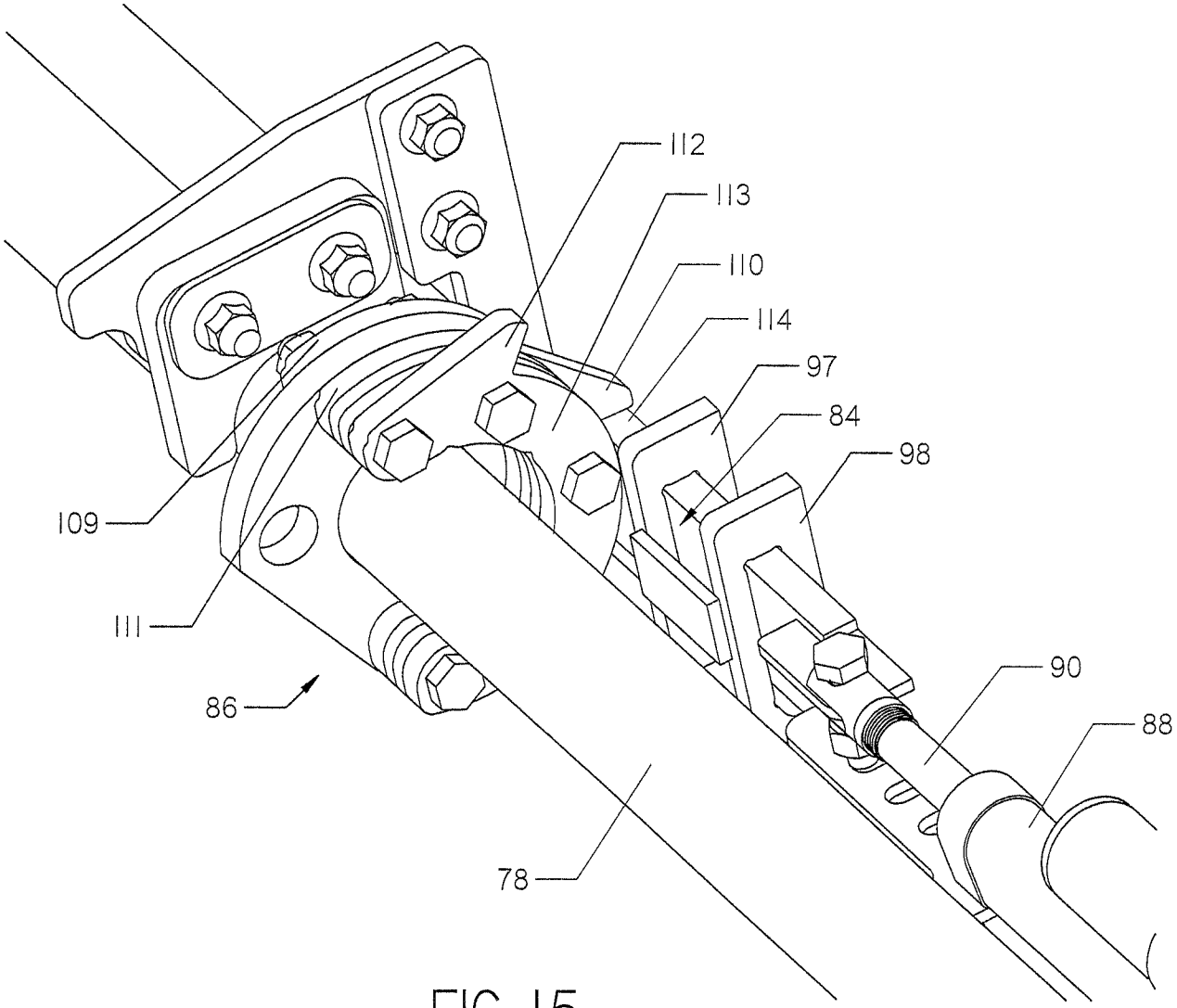
FIG. 15 is a bottom perspective view of a portion of the pipe column selection assembly shown in FIG. 14.

With reference to FIGS. 13-15, to move the shuttle arms 46 to the second column arm position, the rod 90 is extended so as to push the bolt element 84 to midway within the stop zone 98. Because the bolt element 84 is only midway within the stop zone 98, the first hook 108 can pass freely through the stop zone 98, as shown in FIG. 14. However, the rotational path of travel of the second hook 110 is blocked by the bolt element 84, as shown in FIG. 15. Thus, the bolt element 84 does not block the path of travel of any stop element 86 situated nearer the second end 103 of the stop zone 98 than the selected stop element. The engagement of the second hook 110 with the bolt element 84 stops movement of the shuttle arms 46 at the second column arm position as the shaft 78 and pinion gears 64 rotate clockwise. Once the second column 52 is empty, the operator may direct the assembly 48 to move the shuttle arms 46 to the third column arm position.

Figure 17:
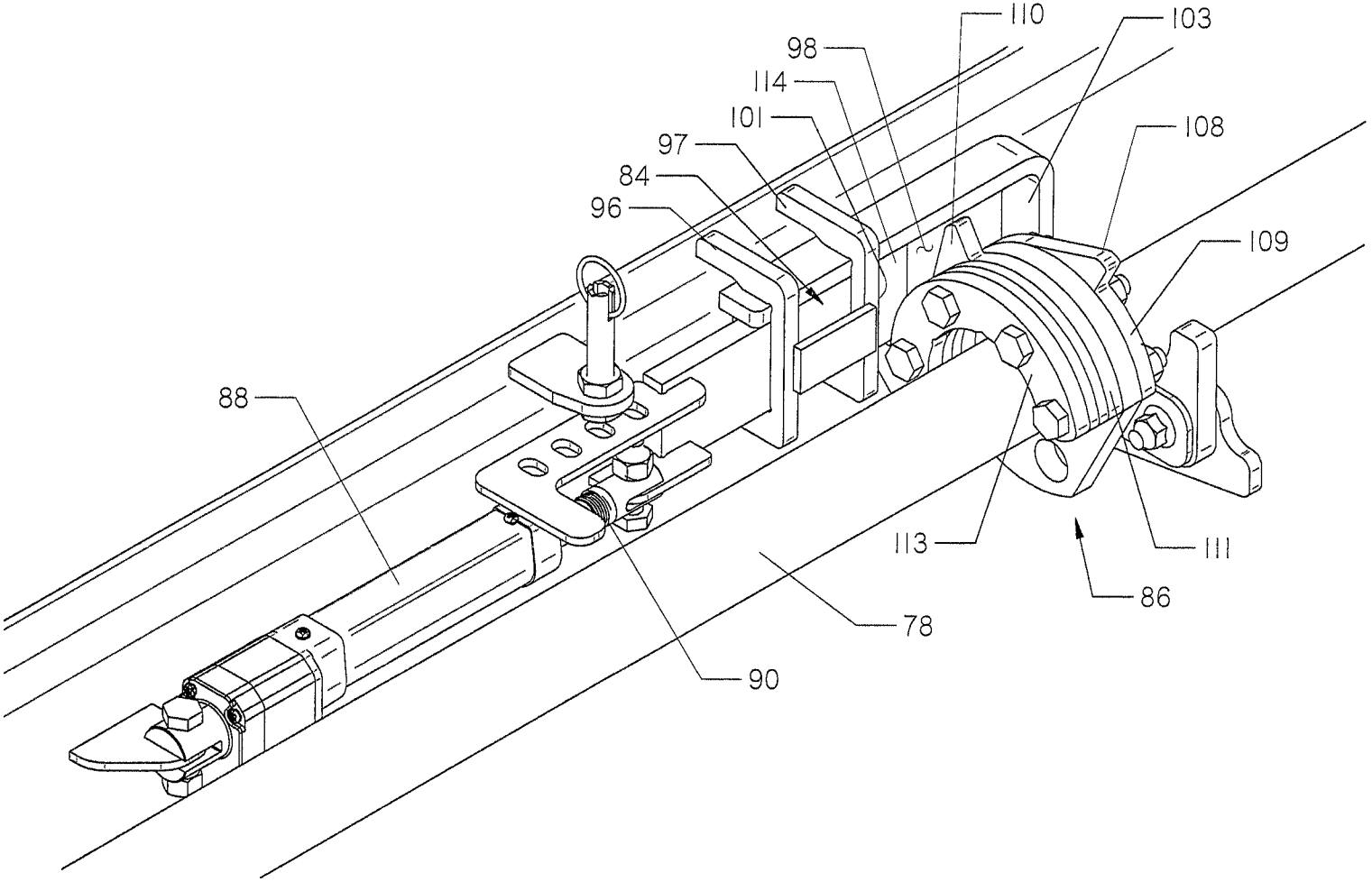
FIG. 17 is an enlarged view of area E shown in FIG. 16.
Figure 18:
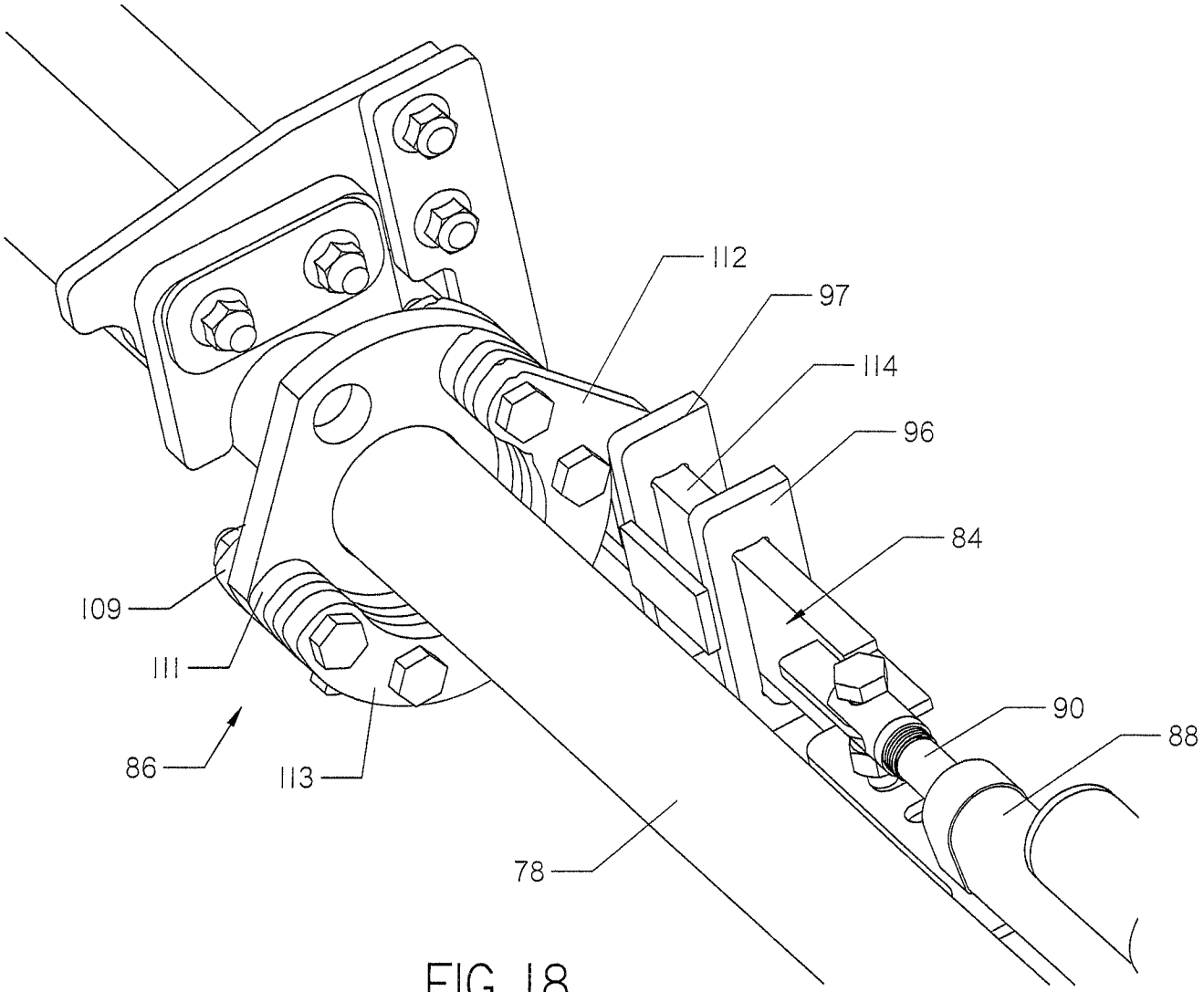
FIG. 18 is a bottom perspective view of a portion of the pipe column selection assembly shown in FIG. 17.

With reference to FIGS. 16-18, to move the shuttle arms 46 to the third column arm position, the rod 90 is only slightly extended, pushing the end section 114 of the bolt element 84 just past the bracket 97. Because the bolt element 84 is only slightly extended into the stop zone 98, the first hook 108 and the second hook 110 can pass freely through the stop zone 98, as shown in FIG. 17. However, the third hook 112 is blocked by the bolt element 84 as the shaft 78 and pinion gears 64 rotate clockwise, as shown in FIG. 18. Engagement of the third hook 112 with an end section 114 of the bolt element 84 holds the shuttle arms 46 in the third column arm position. Once the third column 54 is empty, the operator may direct the assembly 48 to move the shuttle arms 46 to the fourth column arm position.

Figure 20:
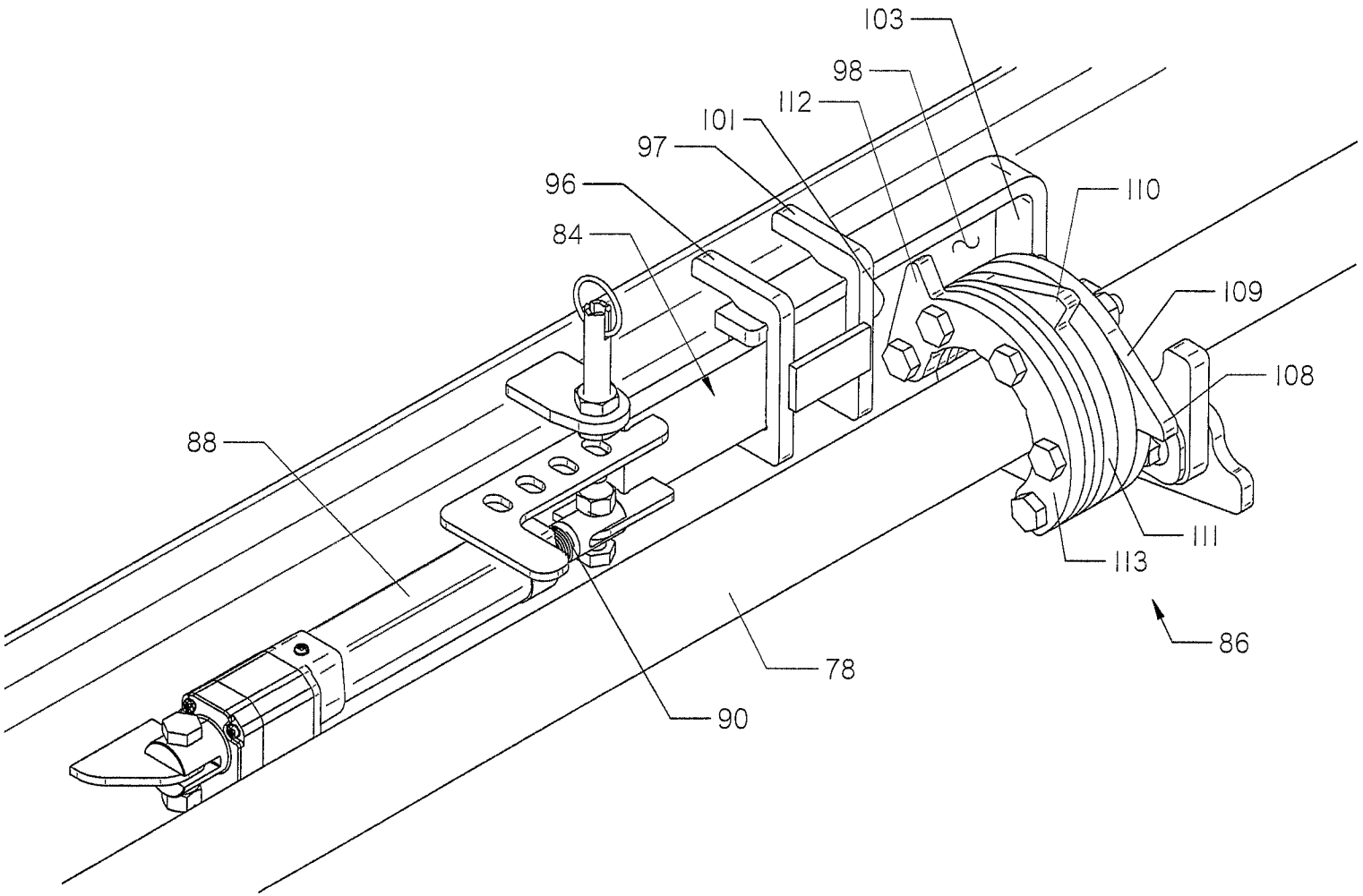
FIG. 20 is an enlarged view of area F shown in FIG. 19.
Figure 21:
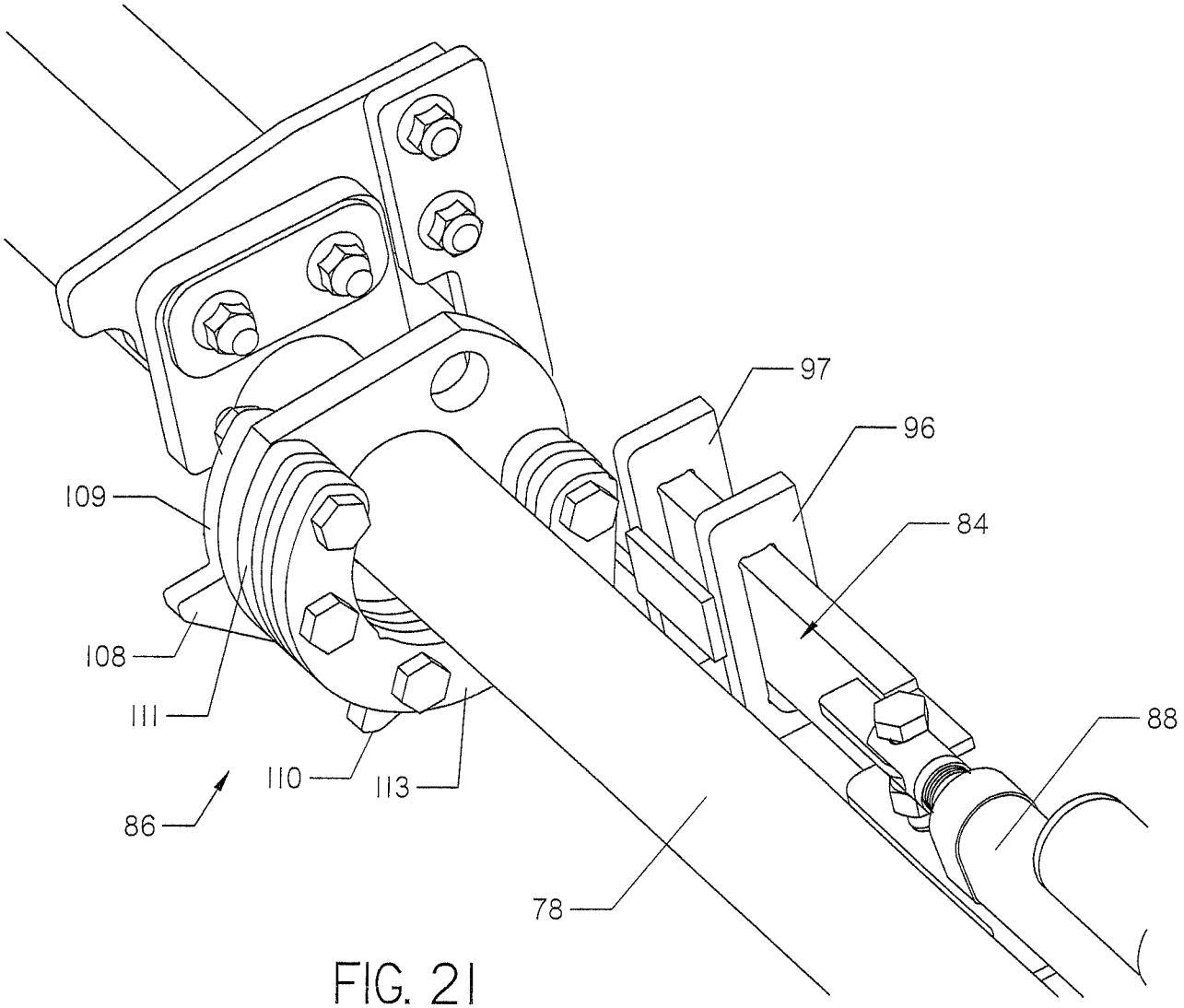
FIG. 21 is a bottom perspective view of a portion of the pipe column selection assembly shown in FIG. 20.

With reference to FIGS. 19-21, the hooks 108, 110, and 112 do not engage with the bolt element 84 when moving the shuttle arms 46 to the fourth column arm position. To move to the fourth arm position, the rod 90 is not extended from the housing 88 and the end section 114 of the bolt element 84 is not pushed into the stop zone 98, as shown in FIG. 20. Because the bolt element 84 is not in the stop zone 98, the first hook 108, the second hook 110, and the third hook 112 can pass freely through the stop zone 98 as the shaft 78 and pinion gears 64 rotate clockwise. Due to the free movement of the hooks, the shaft 78 and pinion gears 64 are able to rotate until the rear stops 55 engages with the ledges 63 formed on the guides 76. Such engagement places the shuttle arms 46 in the fourth column arm position.

The reverse operation occurs when deconstructing a drill string 14. To load pipe sections 16 in the pipe box 44, the operator will direct the assembly 48 to move the shuttle arms 46 to the fourth column arm position. Once the fourth column 56 is full, the operator will direct the assembly 48 to move to the shuttle arms 46 to the third column arm position, and so on.

The pipe column selection assembly 48 may also be used in conjunction with electronic pipe column selection systems, such as a timing or sensor system. A timing system operates by knowing how long it should take the shuttle arms 46 to reach each column 50, 52, 54, or 56 and stopping movement of the shuttle arms accordingly. A sensor system may use a rotation encoder or proximity sensor to stop the shuttle arms 46 at each column 50, 52, 54, or 56. The electronic pipe column selection systems stop movement of the shuttle arms 46 by stopping operation of the hydraulic motors 74.

The pipe handling assembly 34 may be used in conjunction with a pipe sensor assembly and pipe indicators described in United States Patent Publication No. 2017/0159379, authored by Metcalf, et al., the entire contents of which are incorporated herein by reference. To the extent any inconsistencies or discrepancies exist between this document and the document incorporated by reference, it is intended that this document control.

Changes may be made in the construction, operation and arrangement of the various parts, elements, steps and procedures described herein without departing from the spirit and scope of the invention as described in the following claims.

The invention claimed is:

1. An apparatus, comprising:

an elongate frame having a longitudinal axis;

an elongate shuttle arm supported on the frame and having a longitudinal axis, in which the longitudinal axis of the frame is perpendicular to the longitudinal axis of the shuttle arm;

an elongate rotatable shaft supported by the frame and having a longitudinal axis, in which the longitudinal axis of the frame is parallel to the longitudinal axis of the shaft;

a series of longitudinally spaced and angularly offset stop elements supported by the shaft, each stop element having a rotational path of travel; and a bolt element supported on the frame and adjacent the shaft, wherein the bolt element is movable along an axis that is parallel to the longitudinal axis of the frame so as to block the path of travel of a selected one of the stop elements.

2. The apparatus of claim 1 in which the stop elements are situated within a stop zone having opposed first and second ends, in which the stop zone is supported on the frame adjacent to the bolt element, and in which the bolt element is positioned to block the path of travel of the selected one of the stop elements, while not blocking the path of travel of any stop element situated nearer the second end of the stop zone than the selected stop element.

3. The apparatus of claim 1 in which the shuttle arm is longitudinally movable in response to rotation of the shaft.

4. The apparatus of claim 3 in which the shuttle arm is movable to a plurality of arm positions, each arm position corresponding to a selected stop element when engaged with the bolt element.

5. The apparatus of claim 4 further comprising:

a pipe box supported on the frame and having a plurality of columns, each column overlying one and only one arm position of the shuttle arm.

6. The apparatus of claim 1 in which the stop element is a plate having the shape of an unclosed loop, in which the plate at least partially surrounds the shaft.

7. The apparatus of claim 6 in which the plate has an outer edge, in which a hook projects from the outer edge of the plate, and in which the hook is engageable with the bolt element.

8. The apparatus of claim 7 in which the hook has a triangular shape.

9. The apparatus of claim 1 in which the bolt element is an elongate block having a rectangular cross-sectional shape.

10. The apparatus of claim 1 in which the series of stop elements are rigidly attached to the shaft, which is formed as a separate piece therefrom.

11. The apparatus of claim 1 in which the series of stop elements and the shaft are formed as a single piece.

12. The apparatus of claim 1 further comprising:

a pinion gear rotatable in unison with the shaft and engaged with the shuttle arm.

13. The apparatus of claim 12 in which the pinion gear drives movement of the shuttle arm along the axis perpendicular to the longitudinal axis of the shaft.

14. The apparatus of claim 13 in which engagement of a selected one of the stop elements with the bolt element stops rotation of the shaft and stops movement of the shuttle arm.

15. The apparatus of claim 1 further comprising:

an actuator attached to the bolt element, in which extension and retraction of the actuator moves the bolt element longitudinally relative to the shaft.

16. The apparatus of claim 1 in which the series of stop elements comprise three and only three stop elements.

17. The apparatus of claim 1 further comprising:

a pipe box within which a pipe section may be received and stored, in which the pipe box is supported on the frame.

18. A horizontal boring machine, comprising:

the apparatus of claim 1; and a carriage supported on the frame and movable between the first end of the frame and the second end of the frame.

19. The horizontal boring machine of claim 18, further comprising:

a spindle supported on the carriage; and a pipe box supported on the frame;

in which the shuttle arm is movable between the pipe box and the spindle.

20. An apparatus, comprising:

an elongate frame having a longitudinal axis;

an elongate shuttle arm supported on the frame and having a longitudinal axis, in which the longitudinal axis of the frame is perpendicular to the longitudinal axis of the shuttle arm;

an elongate rotatable shaft supported by the frame and having a longitudinal axis, in which the longitudinal axis of the frame is parallel to the longitudinal axis of the shaft;

a series of longitudinally spaced and angularly offset stop elements supported by the shaft, each stop element having a rotational path of travel, in which each stop element is a plate having the shape of an unclosed loop, in which the plate at least partially surrounds the shaft; and a bolt element supported on the frame and movable along the longitudinal axis of the frame so as to block the path of travel of a selected one of the stop elements.

* * * * *